US006407593B1

(12) United States Patent
Kawamoto et al.

(10) Patent No.: US 6,407,593 B1
(45) Date of Patent: Jun. 18, 2002

(54) ELECTROMAGNETIC LOAD CONTROL APPARATUS HAVING VARIABLE DRIVE-STARTING ENERGY SUPPLY

(75) Inventors: Satoru Kawamoto, Chita-gun; Shinichi Maeda, Hekinan, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/593,093

(22) Filed: Jun. 13, 2000

(30) Foreign Application Priority Data

| | | |
|---|---|---|
| Jun. 30, 1999 | (JP) | 11-185672 |
| Jun. 30, 1999 | (JP) | 11-185673 |
| Jun. 30, 1999 | (JP) | 11-185674 |
| Feb. 23, 2000 | (JP) | 12-046421 |

(51) Int. Cl.[7] ..... H03B 1/00; H03K 3/00

(52) U.S. Cl. ..... 327/110; 361/155; 361/156; 361/160

(58) Field of Search ..... 327/110, 108, 327/300, 304, 589, 536, 537; 307/140; 361/160, 154, 155, 156, 191

(56) References Cited

U.S. PATENT DOCUMENTS

| | | | | |
|---|---|---|---|---|
| 4,344,003 A | * | 8/1982 | Harmon et al. | 327/543 |
| 4,604,675 A | | 8/1986 | Pflederer | 361/155 |
| 5,532,526 A | | 7/1996 | Ricco et al. | 307/104 |
| 5,717,562 A | | 2/1998 | Antone et al. | 361/155 |
| 5,734,291 A | * | 3/1998 | Tasdighi et al. | 327/537 |
| 5,883,473 A | * | 3/1999 | Li et al. | 315/225 |
| 5,907,466 A | | 5/1999 | Dressler et al. | 361/156 |
| 6,041,011 A | * | 3/2000 | Umezawa et al. | 365/226 |
| 6,075,295 A | * | 6/2000 | Li | 307/39 |
| 6,177,782 B1 | * | 1/2001 | L'Hermite et al. | 323/222 |

FOREIGN PATENT DOCUMENTS

| | | |
|---|---|---|
| EP | 0 911 840 A2 | 4/1999 |
| JP | 10-205379 | 8/1998 |
| JP | 10-205380 | 8/1998 |

* cited by examiner

*Primary Examiner*—Toan Tran
*Assistant Examiner*—Quan Tra
(74) *Attorney, Agent, or Firm*—Nixon & Vanderhye PC

(57) ABSTRACT

In an electromagnetic injector control apparatus for an engine, a capacitor is connected to a power supply and a solenoid of an injector for accumulating electric charge at a voltage higher than that of the power supply. A driving circuit controls transistors to supply energy from the power supply to the solenoid during an operation period of the solenoid. The driving circuit also controls a transistor so that a timing to start supplying the accumulated energy from the capacitor to the solenoid is delayed from a timing to start the operation of the solenoid as the voltage of the capacitor increases. Thus, the accumulated energy is used to speed up the operating response of the solenoid. The supply of the accumulated energy to the solenoid is stopped when a current flowing in the solenoid reaches a predetermined cut-off level. The capacitor is set to retain an offset of at least a predetermined quantity to be left therein when energy of a counter-electromotive force of the solenoid is recovered at the end of operation of the solenoid.

51 Claims, 14 Drawing Sheets

ELECTROMAGNETIC LOAD CONTROL APPARATUS HAVING VARIABLE DRIVE-STARTING ENERGY SUPPLY

CROSS REFERENCE TO RELATED APPLICATION

This application relates to and incorporates herein by reference Japanese Patent Applications No. 11-185672, No. 11-185673, No. 11-185674 and 2000-46421 filed Jun. 30, 1999, Jun. 30, 1999, Jun. 30, 1999 and Feb. 23, 2000, respectively.

BACKGROUND OF THE INVENTION

The present invention relates to an electrical load control apparatus which makes an operation response characteristic thereof faster by discharging electrical energy accumulated typically in a capacitor. The present invention may be applied to an electromagnetic valve for injecting fuel to improve opening response of the electromagnetic valve.

It is proposed to speed up the opening response of an electromagnetic valve that energy accumulated in a capacitor by using a voltage raising circuit such as a DC-DC converter is discharged to drive the electromagnetic valve. Energy is accumulated in the capacitor to be to passed through the electromagnetic valve. This conventional technique is disclosed in U.S. Pat. No. 5,907,466 (JP-A-9-115727), U.S. Pat. No. 4,604,675 (JP-B2-7-78374) and U.S. Pat. No. 5,532, 526 (JP Patent 2598595).

In addition, in recent years, it is proposed to attain another injection with a timing different from the timings of the conventional injections as a solution to reduce exhausted emissions. Such an another injection is injections (multi-stage injections) other than normal pilot and main injections, that is, multiple injections before and after the pilot and main injections which are carried out under injection control in a diesel engine. Alternatively, such an another injection is an injection carried out in the course of an injection of another cylinder in a multi-cylinder injection system.

In multi-stage injections or multi-cylinder injections involving a plurality of cylinders, injections with different injection periods are carried out at different intervals during a short period of time such as the period of a combustion process and, in addition, the number of cylinders involved in the injections also varies as well. In order to meet such requirements, in an apparatus disclosed in JP-A-10-205380, a capacitor is used for accumulating energy with an amount large enough for accomplishing a plurality of injections in advance. During a period of time between the start of an injection and an event in which the voltage of the capacitor drops to a level below a predetermined electric potential, energy is supplied from the capacitor to the electromagnetic valve.

However, this apparatus is incapable of ensuring that energy of a desired amount be accumulated in the capacitor. That is, the quantity of energy accumulated in the capacitor prior to the start of an injection including energy recovered from the electromagnetic valve varies from injection to injection so that a voltage appearing at the capacitor before an injection also varies from injection to injection. Thus, in the conventional technique of supplying energy from the capacitor to the electromagnetic valve during a period of time between the start of an injection and an event in which the voltage of the capacitor drops to a level below a predetermined electric potential, the quantity of the energy and the speed to supply the energy from the capacitor to the electromagnetic valve vary in accordance with the voltage of the capacitor appearing at the start of an injection. As a result, the conventional apparatus fails to assure a uniform degree of opening of the electromagnetic valve and a uniform response characteristic thereof. Thus, the electromagnetic valve is not driven to operate in a stable manner.

SUMMARY OF THE INVENTION

It is thus an object of the present invention to ensure a stable operation of an electrical load driven by an apparatus by using energy accumulated in energy accumulation device such as a capacitor.

According to one aspect of the present invention, an electrical load is driven with a current which varies with an accumulated energy level. That is, the electrical load is provided with electric energy for speeding up an operating response of the electrical load during an operation period of the electrical load at a timing dependent on an energy accumulation level in an energy accumulation device. In the case of a capacitor, the energy accumulation level is the voltage of the capacitor. Thus, energy is supplied at a timing independent of whether the energy accumulation level is high or low, assuring a desired operation.

In addition, the electrical load is preferably provided with energy for speeding up an operating response of the electrical load in accordance with the voltage of a vehicle-mounted power supply with a delay timing and in such a manner that, the lower the voltage of the vehicle-mounted power supply, the more the timing to start the operation of the electrical load is expedited.

According to another aspect of the present invention, the energy supply from an energy accumulation device such as a capacitor is stopped based on a current flowing through the electrical load.

According to a further aspect of the present invention, an energy accumulation device such as a capacitor is set to retain an offset of at least a predetermined quantity to be left in the energy accumulation device when energy of a counter-electromotive force is recovered at the end of a period to supply energy to an electrical load. With an offset of a predetermined quantity left as a capacitor voltage, it is thus possible to electrically charge and discharge the capacitor in the area where the valve closing time slightly varies with a change in capacitor voltage so as to make the valve closing time remain virtually unchanged.

According to a still further aspect of the present invention, electrical loads not driven at the same time among a plurality of electrical loads are put in a group, and energy from an energy accumulation device is supplied to the group of electrical loads. Thus, the number of energy supplying devices can be reduced.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF THE PREFERRED EMBODIMENT

Figure 1:
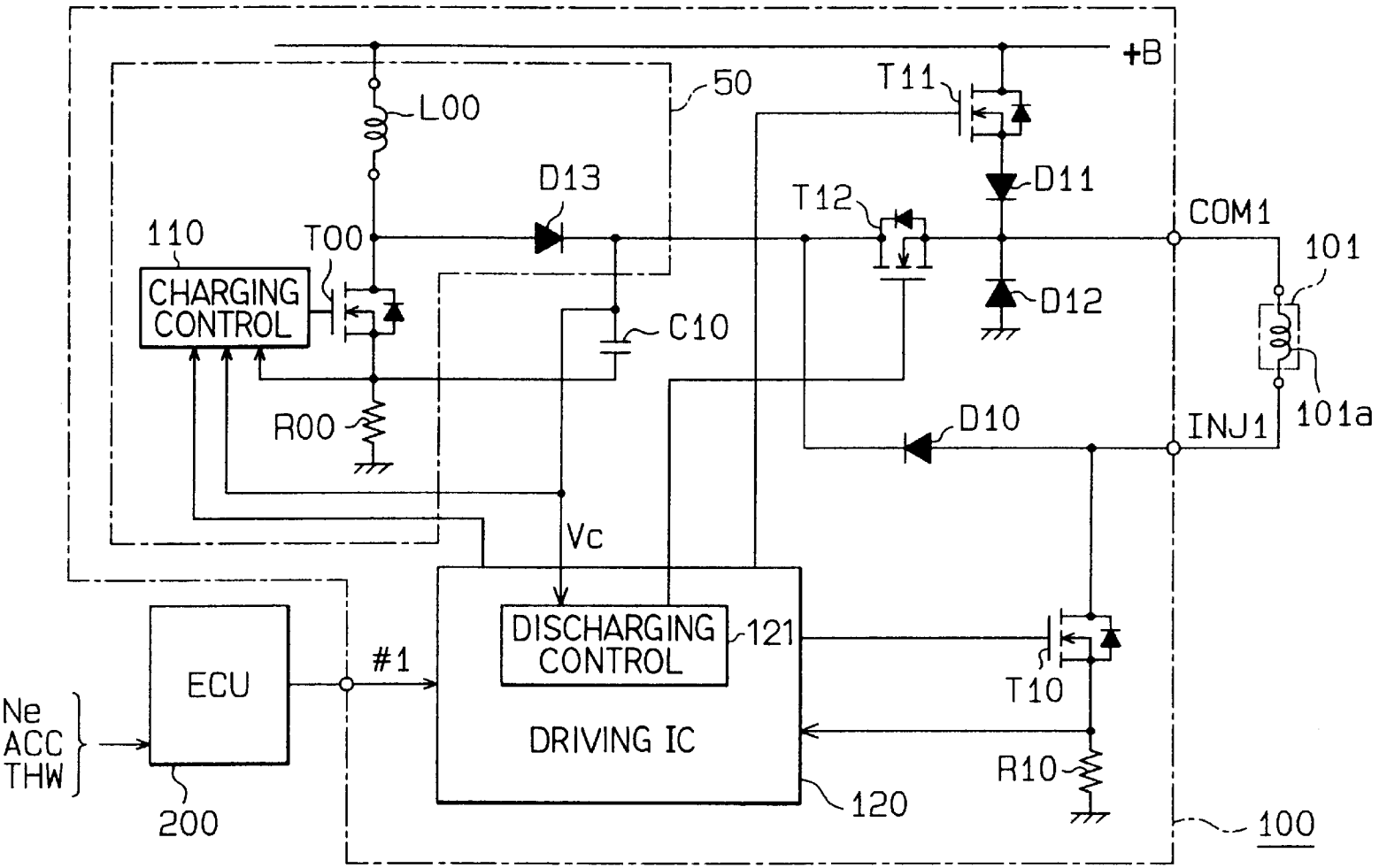
FIG. 1 is a circuit diagram showing an injector control apparatus according to a first embodiment of the present invention.

The present invention will be described in further detail with respect to a plurality of embodiments, in which the same or similar reference numerals designate the same or similar parts. The following embodiments are implemented as a common rail-type fuel injection system of a four-cylinder diesel engine for a vehicle. High-pressure fuel accumulated inside a common rail in the fuel injection system is supplied to each of the cylinders of the diesel engine by injection carried out as a result of driving the injector current in a fuel combustion process in those embodiments, multi-stage injections for performing an operation to inject fuel to cylinders a plurality of times and multi-cylinder injections for performing injections of fuel by driving two injectors at the same time are carried out.

First Embodiment

Referring first to FIG. 1, an injector control apparatus is shown to have one injector 101 for injecting fuel to a cylinder of a diesel engine (not shown). The injector 101 is provided for each cylinder in the case of a multi-cylinder engine. The apparatus comprised an EDU (electric driver unit) 100 for driving the injector 101 and an ECU (electronic control unit) 200 connected to the EDU 100. The ECU 200 includes a known microcomputer comprising, among other components, a CPU (central processing unit) and a variety of memories (RAM, ROM and the like). The ECU 200 generates an injection signal for each injector 101 and outputs the signal to the EDU 100. The generation of the injection signals is based on information on the operating state of the engine output by a variety of sensors. The information includes engine speed Ne, accelerator position ACC and coolant temperature THW of the engine.

The injector 101 is an electromagnetic valve of a normally-closed type. The injector 101 has a solenoid 101*a* which is an electrical load. When an electric current flows through the solenoid 101*a*, a valve body (not shown) resists biasing force of a return spring (not shown), moving to an opened-valve position so that fuel is injected. When the current flowing through the solenoid 101*a* is cut off, on the other hand, the valve body returns to its original closed-valve position, halting the injection of fuel.

One end of an inductor L00 is connected to a power supply line +B of a battery (not shown) serving as a vehicle-mounted power supply (12 V). The other end of the inductor L100 is connected to a transistor T00 which is used as a switching device. The gate terminal of the transistor T00 is connected to a charging control circuit 110. The transistor T00 is turned on and off in accordance with a signal output of the charging control circuit 110. The charging control circuit 110 employs an oscillation circuit of a self-excitation type. The transistor T00 is connected to the ground through a current detection resistor R00.

A junction between the inductor L00 and the transistor T00 is connected to one end of a capacitor C10 serving as an energy accumulation device through a diode D13 used for blocking a reversed current. The other end of the capacitor C10 is connected to a junction between the transistor T00 and the resistor R00. Thus, the capacitor C10 is always offset to have a predetermined electric discharge.

The inductor L00, the transistor T00, the charging current detection resistor R00, the charging control circuit 110 and the diode D13 form a DC-DC converter circuit 50 which serves as a voltage raising or booster device. By turning the transistor T00 on and off alternately, the capacitor C10 can be electrically charged through the diode D13. As a result, the capacitor C10 can be electrically charged to a voltage higher than the voltage (12 V) of the power supply line +B of the battery. The charging current detection resistor R00 monitors the current flowing through the transistor T00. The result of monitoring is fed back to the charging control circuit 110 which turns on and off the transistor T00. In this way, the capacitor C10 is electrically charged during periods of time which are controlled with a high degree of efficiency.

A driving IC 120 receives injection signal #1 of cylinder #1, that is, the first cylinder, from the ECU 200. A transistor T12 is temporarily turned on at a timing of inversion of injection signal #1 from an off-state (low level) to an on-state (high level), thereby to supply electric energy accumulated in the capacitor C10 to the injector 101 in an electrical discharge. Specifically, the transistor T12 is provided between the capacitor C10 and a common terminal COM1.

When the transistor T12 is turned on by the driving IC 120, energy accumulated in the capacitor C10 is supplied to the injector 101 through the common terminal COM1. By discharging energy from the capacitor C10 in this way, a large current flows through the injector 101 as a current to drive the injector 101.

The low side end of the injector 101 is connected to a transistor T10 through a terminal INJ1 of the driving circuit 100. When injection signal #1 received from the ECU 200 is set to the high level, the transistor T10 is turned on. The transistor T10 is connected to the ground by an injector current detection resistor RI0 which detects an injector current I flowing through the solenoid 101*a* employed in the injector 101. The result of the detection is fed back to the driving IC 120.

The common terminal COM1 is also connected to the power supply line B+ of the battery through a diode D11 and a transistor T11. The driving IC 120 turns the transistor T11 on and off in accordance with the magnitude of the detected injector current flowing through the solenoid 101*a* employed in the injector 101 so that a constant current is supplied to the injector 101 from the power supply line +B. A diode D12 serves as a feedback diode. Specifically, when the transistor T11 is turned off, the current flowing through the solenoid 101*a* employed in the injector 101 is fed back through the diode D12.

In actual operation, first of all, the transistor T12 is turned on at the rising edge of the injection signal which serves as a driving command. At that time, energy is discharged from the capacitor C10, causing a large current to flow from the capacitor C10 to the injector 101 as the current for driving the injector 101. Then, the driving current is cut off but a fixed current is supplied through the transistor T11. It should be noted that the diode D11 prevents the current from flowing to the power supply line +B from the terminal COM1 which is raised to a high electrical potential when the energy is discharged from the capacitor C10.

The capacitor C10 employed in this embodiment is capable of storing in advance energy required for opening the valve several times. Specifically, the capacitor C10 has a high fully-charged voltage or a large capacity.

The driving IC 120 includes a discharging control circuit 121 for controlling timing to supply energy to the injector 101 to open the valve as described later. Specifically, the discharging control circuit 121 monitors the voltage Vc of the capacitor C10 and controls the transistor T12 to turn on and off in accordance with the voltage Vc of the capacitor C10.

The solenoid 101*a* employed in the injector 101 wired to the terminal INJ1 is connected to the capacitor C10 through a diode D10. When the injector current is cut off, a fly-back energy, that is, energy of a counter-electromotive force of the solenoid 101*a*, is recovered to the capacitor C10 by way of the diode D10.

In this embodiment, the transistor T10 functions as a first energy supply device for supplying energy of the battery power supply to the solenoid 101*a*. On the other hand, the transistor T12 functions as a second energy supply device for supplying energy accumulated in the capacitor C10 to the solenoid 101*a*.

Figure 2:
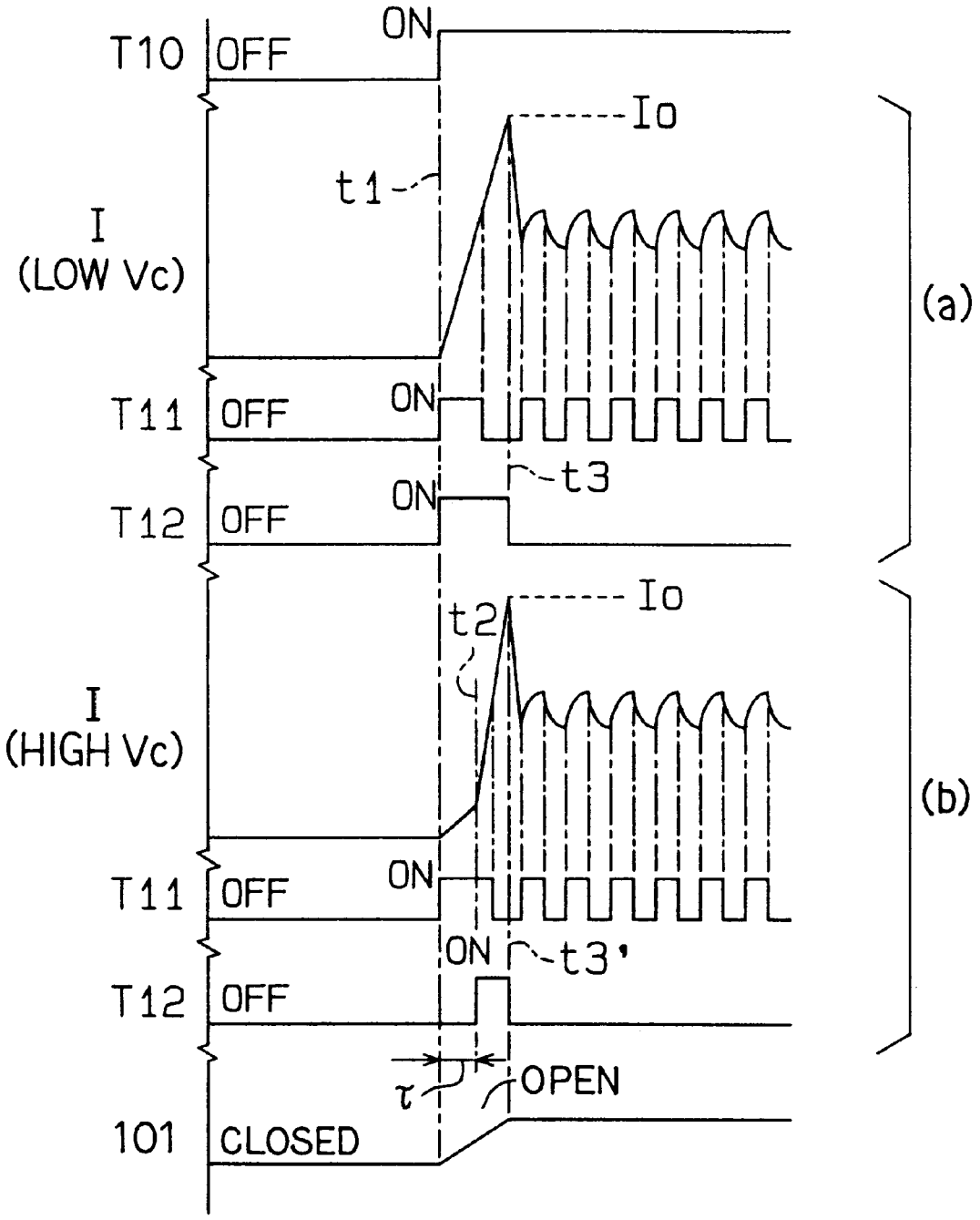
FIG. 2 is a timing diagram showing an operation of the first embodiment.

In this embodiment, prior to an injection (turning on of transistor T10 from turned- off-state) shown in FIG. 2, the capacitor C10 is fully electrically charged. At a point of time t1, when injection signal #1 is turned on to turn on the transistor T10, rising to the logically high level, the transistors T10, T11 and T12 are turned on to start an injection by the injector 101. With the transistor T12 turned on, the injector current detection resistor R10 monitors the injector current I flowing through it. As the magnitude of the detected injector current I reaches a predetermined cut-off level I0 at a point of time t3, the transistor T12 is turned off. This is because a predetermined energy required for one injection is considered to have been discharged from the capacitor C10.

As described above, the transistor T12 is turned on only during a certain period at the beginning of the injection to discharge energy accumulated in the capacitor C10 to the injector 101. In this way, a large current flows through the solenoid 101*a* of the injector 101, speeding up the valve opening response of the injector 101.

At that time, the discharging control circuit 121 shown in FIG. 1 operates as follows.

First of all, the timing to start the electrical discharge is controlled in dependence on the voltage Vc of the capacitor C10 as shown in FIG. 2. Specifically, the higher the voltage Vc of the capacitor C10, the longer the time by which the on timing of the transistor T12, that is, the start of current conduction, is delayed from the rising edge of injection signal #1 in order to supply energy discharged from the capacitor C10 to the injector 101 with optimum timing. That is, the higher the level of the accumulated energy, the longer the time by which the start of the period to supply the energy or the timing to start the operation of the solenoid 101 is delayed from the rising edge of injection signal #1. In FIG. 2, $\tau$ denote the length of a time by which the on timing of the transistor T12 is to be delayed. The magnitude of the delay $\tau$ depends on the voltage vc of the capacitor C10 as understood from comparison of (a) and (b) in FIG. 2. The delay $\tau$ can be determined with ease by comparison of a ramp voltage of a voltage starting at the rising edge of injection signal #1 with the voltage Vc of the capacitor C10 by means of a comparator.

Figure 3:
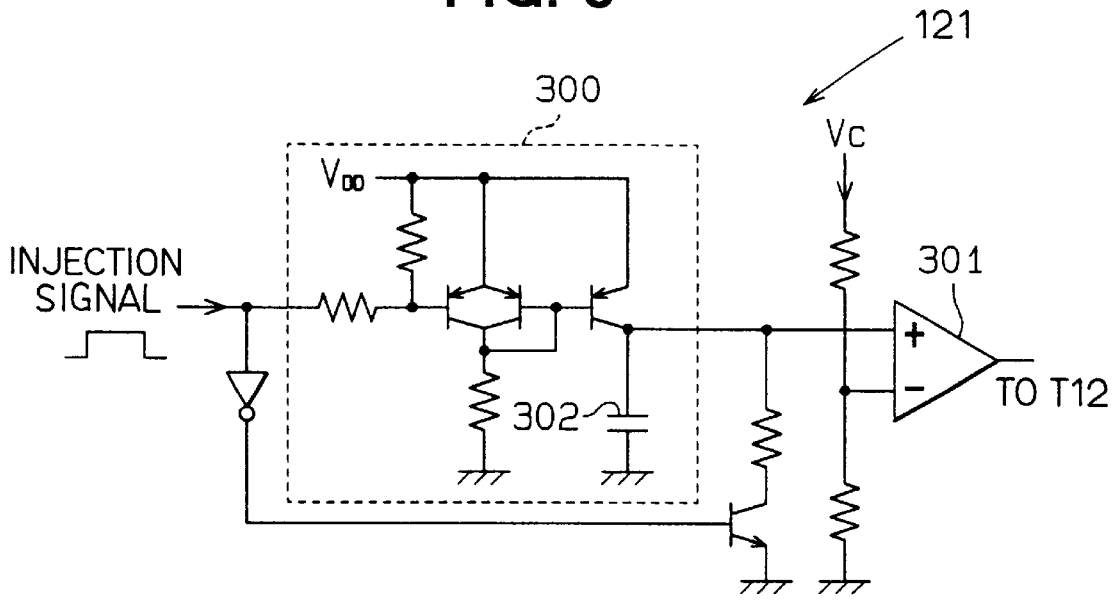
FIG. 3 is a circuit diagram showing a discharging control circuit in the first embodiment.

Specifically, the discharging control circuit 121 includes a circuit shown in FIG. 3. The circuit comprises a ramp circuit 300 and a comparator 301. The ramp circuit 300 has a capacitor 302. An input injection signal electrically charges the capacitor 302 with a fixed voltage VDD used as a source of electric charge. A voltage appearing at the capacitor 302 produces a ramp voltage as a result of the electrical charging operation. The comparator 301 inputs the voltage Vc of the capacitor C10 and this ramp voltage output by the ramp circuit 300. The output terminal of the comparator 301 is connected to the transistor T12.

The comparator 301 compares the voltage vc of the capacitor C10 with the ramp voltage output by the ramp circuit 300. A time it takes for the ramp voltage output by the ramp circuit 300 to attain the voltage Vc of the capacitor C10 is the delay time $\tau$. As the ramp voltage output by the ramp circuit 300 attains the voltage vc of the capacitor C10 at a point of time t10 shown in FIG. 4, a signal to turn on the transistor T12 is generated.

Figure 4:
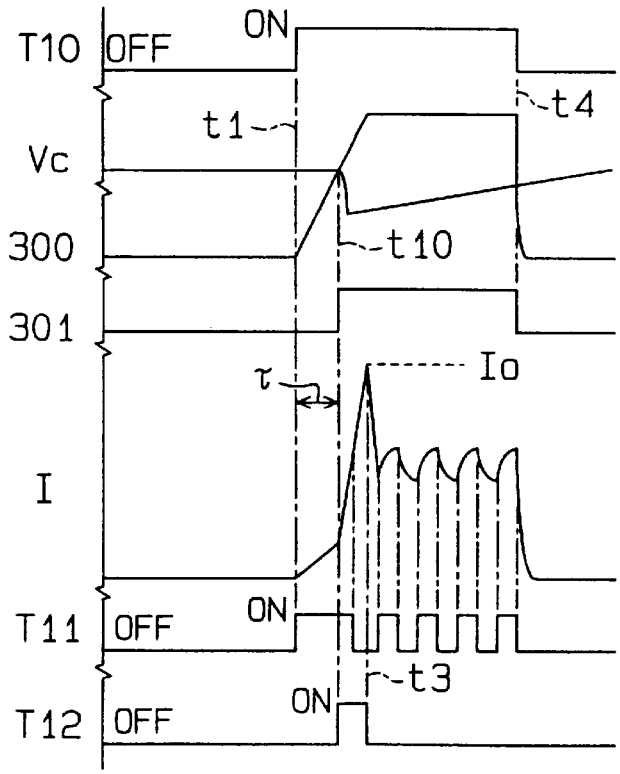
FIG. 4 is a timing diagram showing an operation of the first embodiment.

As shown in FIG. 4, at a point of time t1 or on the rising edge of injection signal #1 from the off-state to an on-state, the transistor T11 is turned on to allow a current to start to flow from the power supply line +B of the battery as an injector current I the case of a low voltage Vc of the capacitor C10 shown in (a) of FIG. 2, the magnitude of a delay time $\tau$ is so small so that the transistor T12 is driven by the discharging control circuit 121 to start conducting a current almost at the same time as the rising edge of ignition signal #1 from an off-state to an on-state. As a result, no current flows through the transistor T11. Then, the injector current caused by an electrical discharge accompanying the conduction of the transistor T12 rises sharply but is cut off at a point of time t3 when the current I reaches the predetermined cut-off current value I0 by turning off the transistor T12. By ending the electrical discharge of the capacitor C10 in this way, energy can be expended to open the valve of the injector 101 with a high degree of efficiency.

In the case of a high voltage Vc of the capacitor C10 shown in (b) of FIG. 2, on the other hand, the magnitude of the delay time τ is large so that the transistor T12 is driven by the discharging control circuit 121 to start conducting a current after a relatively long time has lapsed since the rising edge of ignition signal #1 from an off-state to an on-state. Since the transistor T11 is turned on at the rising edge of injection signal # from the off-state to the on-state, however, the current starts to flow through the transistor T11 from the power supply line +B of the battery as the injector current I. Then, the transistor T12 is turned on at a point of time t2, causing the injector current I attributed to the electrical discharge accompanying the conduction of the transistor T12 to rise sharply. However, the transistor T12 is turned off to end the electrical discharge at a point of time t3' when the injector current I reaches the predetermined current value I0. In this case, since the voltage Vc of the capacitor C10 is high, the injector current rises more sharply than that of the low voltage Vc.

Since the timing to supply the energy is delayed by the discharging control circuit 121, however, the energy is supplied to open the valve of the injector 101 with a high degree of efficiency. In addition, the opening response of the electromagnetic valve can be speeded up in a stable manner without causing the injector current to drop at the end of the electrical discharge.

After energy has been discharged from the capacitor C10, that is, after the operation to supply energy has been ended in this way, the transistor T11 is subsequently controlled to alternately turn on and off, flowing the constant current through the solenoid 101*a* employed in the injector 101 by way of the diode D11. That is, the driving IC 120 turns the transistor T11 on and off in accordance with the magnitude of the driving current (or the injector current I) detected by the injector current detection resistor R10 to maintain the driving current at a predetermined value. As a result, the valve of the injector 101 is kept in an opened state.

When injection signal #1 is turned off later on, the transistor T10 is also turned off to close the valve of the injector 101, hence, terminating the injection by the injector 101. When the injector current I of the injector 101 is cut off, energy of a counter-electromotive force is returned to the capacitor C10 by way of the diode D10.

After that, the operation to turn the transistor T00 on and off is started to electrically charge the capacitor C10 by the DC-DC converter circuit 50. It should be noted that, in order to stabilize the current discharged from the capacitor C10, the electrical charging operation by means of the DC-DC converter circuit 50 is inhibited while the transistor T12 is conducting.

Thereafter, injections based on the injector current are carried out consecutively one after another to perform multi-stage or multi-cylinder injections.

As described above, the first embodiment has the following characteristics.

The discharging control circuit 121 provides the solenoid 101*a* with energy for speeding up an operating response of the solenoid 101*a* during an operation period of the solenoid 101*a* at a timing dependent on energy accumulation level represented by the voltage Vc of the capacitor C10. That is, the discharging control circuit 121 provides the solenoid 101*a* with energy only during an operation period of the solenoid 101*a*, and in order to speed up an operating response of the solenoid 101*a*, the energy is supplied to the solenoid 101*a* at a timing dependent on the energy accumulation level represented by the voltage Vc of the capacitor C10.

By controlling the timing to supply energy discharged from the capacitor C10 to the injector 101 in accordance with the electrically charging state of the capacitor C10 (that is, the voltage Vc of the capacitor C10) in this way, the opening response of the electromagnetic valve can be speeded up and stabilized. As a result, a stable operation of the injector 101 or the solenoid 101*a* can be assured even if energy is expended frequently.

In the first embodiment, in place of delaying the turning-on timing of the transistor T12 based on the capacitor voltage Vc to control the injector current I at the time of starting the injection, the transistor T12 may be duty-controlled to control the injector current at the time of starting the injection. Alternatively, the transistor T12 may be driven in its linear operation range by varying the gate voltage to control the injector current at the time of starting the injection.

Second Embodiment

Figure 5:
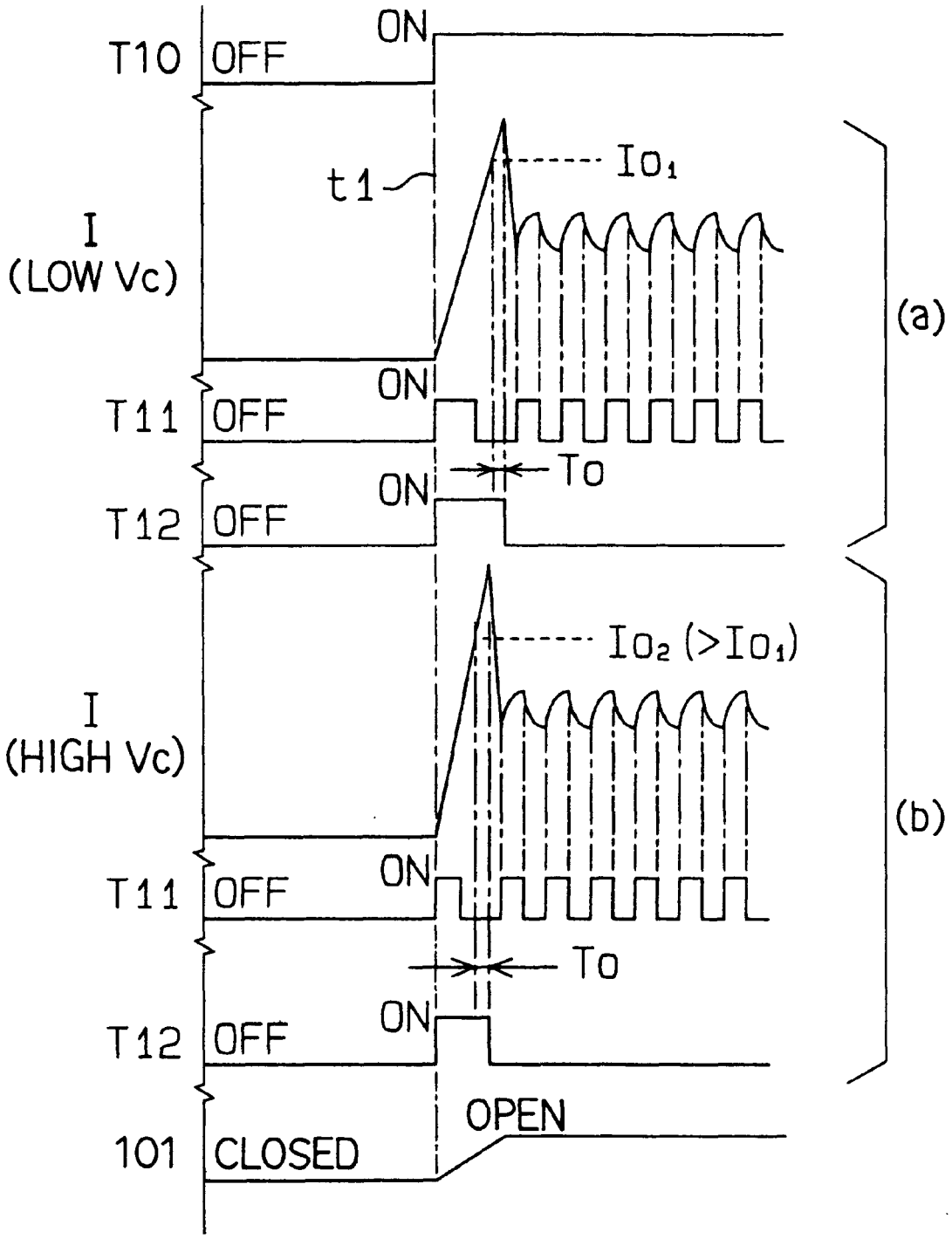
FIG. 5 is a timing diagram showing an operation of a second embodiment of the present invention.
Figure 6:
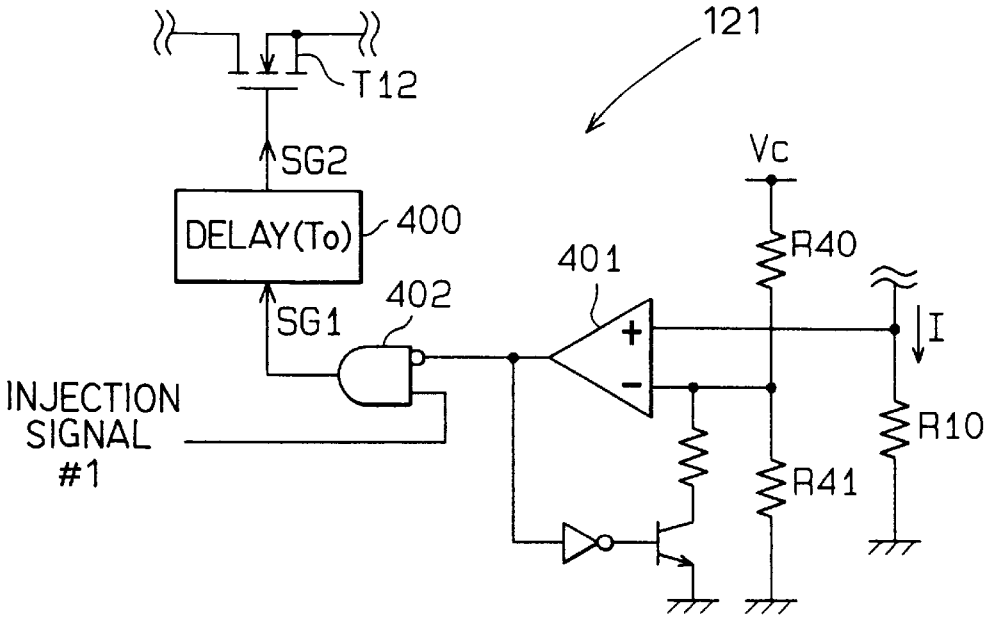
FIG. 6 is a circuit diagram showing a discharging control circuit in the second embodiment.
Figure 7:
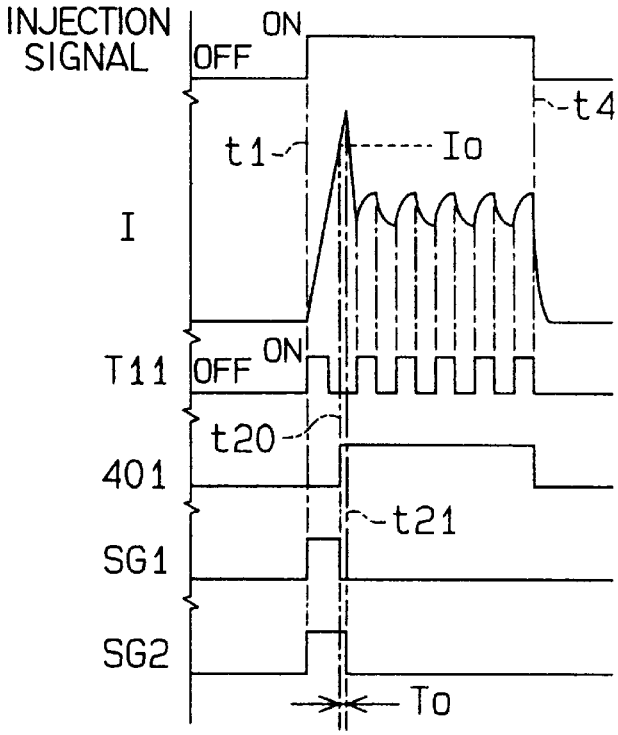
FIG. 7 is a timing diagram showing an operation of the second embodiment.

A second embodiment is shown in FIGS. 5, 6 and 7. In this embodiment, in control of the timing to end the electrical discharge according to the voltage Vc of the capacitor C10, the cut-off current I0 is set at such a magnitude that, the higher the voltage Vc of the capacitor C10, the greater the magnitude. As shown in FIG. 5, the cut-off current I02 for the higher capacitor voltage Vc (shown in (b) of FIG. 5) is set to be larger than the cut-off current I01 for the lower capacitor voltage Vc (shown in (c) of FIG. 5).

In addition, the timing to turn off the transistor T12 is further delayed by a predetermined period of time T0. Specifically, the energy accumulated in the capacitor C10 is supplied to the solenoid 101*a* to start the operation of the solenoid 101*a* and, as the injector current I flowing through the solenoid 101*a* reaches the predetermined level of the cut-off current I0, the energy supply to the solenoid 101*a* is cut off after a predetermined of time lapses since detection of the event in which the injector current flowing through the solenoid 101*a* reaches the predetermined level of the cut-off current I0 wherein, the higher the voltage Vc of the capacitor C10, the higher the level of the cut-off current I0. By delaying the timing to end the electrical discharge in this way, the supply of energy by the electrical discharge can be sustained as long as the energy is required.

In the second embodiment, the discharging control circuit 121 is configured as shown in FIG. 6. The discharging circuit 121 comprises a falling-edge delay circuit 400 and a comparator 401. The comparator 401 compares a voltage representing the injector current I flowing through the injector 101 with a comparison voltage output by a potentiometer comprising the resistors R40 and R41 connected to each other in series. The comparison voltage represents the level of the cut-off current I0. Since the voltage Vc of the capacitor C10 is applied to the series circuit comprising the resistors R40 and R41, the level of the cut-off current I0 represented by the comparison voltage is proportional to the voltage Vc. The output terminal of the comparator 401 is connected to the falling-edge delay circuit 400 through a gate 402. The output terminal of the falling-edge delay circuit 401 is connected to the transistor T12. At the time the injection signal #1 is turned on, the result of comparison output by the comparator 401 turns on the transistor T12 through the falling-edge delay circuit 400. As a result, the transistor T12 is turned of f after the fixed delay time T0 has lapsed since the injector current reached the level of the cut-off current I0.

As shown in (b) of FIG. 5, the higher the voltage Vc of the capacitor C10, the more abrupt the rising edge of the injector current I. However, the more abrupt the rising edge of the injector current, the higher the level of the cut-off current I0. At the high voltage Vc, the abrupt rising edge of the injector current I tends to expedite the termination of the supply of the accumulated energy due to the electrical discharge of the capacitor C10. As a result, the opening response of the electromagnetic valve can be speeded up in a stable manner without a current drop after the electrical discharge.

As described above, the cut-off current value I0 is also raised in the case of high voltage Vc of the capacitor Vc and supply of energy is terminated after the fixed period of time T0 has lapsed since detection of an event in which the injector current I reaches the level of the cut-off current I0. It should be noted, however, that it is also possible to terminate supply of energy as soon as the injector current I attains the level of the cut-off current I0 without providing the time delay T0 after detection of an event in which the injector current I reaches the level of the cut-off current I0.

Third Embodiment

In the first embodiment, variations in voltage of the power supply line +B of the battery are not taken into consideration in spite of the fact that the voltage decreases in some cases. That is, in the case of a high voltage appearing on the power supply line +B of the battery shown in (a) of FIG. 11, the opening response of the electromagnetic valve can be speeded up since energy is supplied to the injector 101 in the electrical discharge of the capacitor C10 in an operation to open the valve with a high degree of efficiency.

Figure 11:
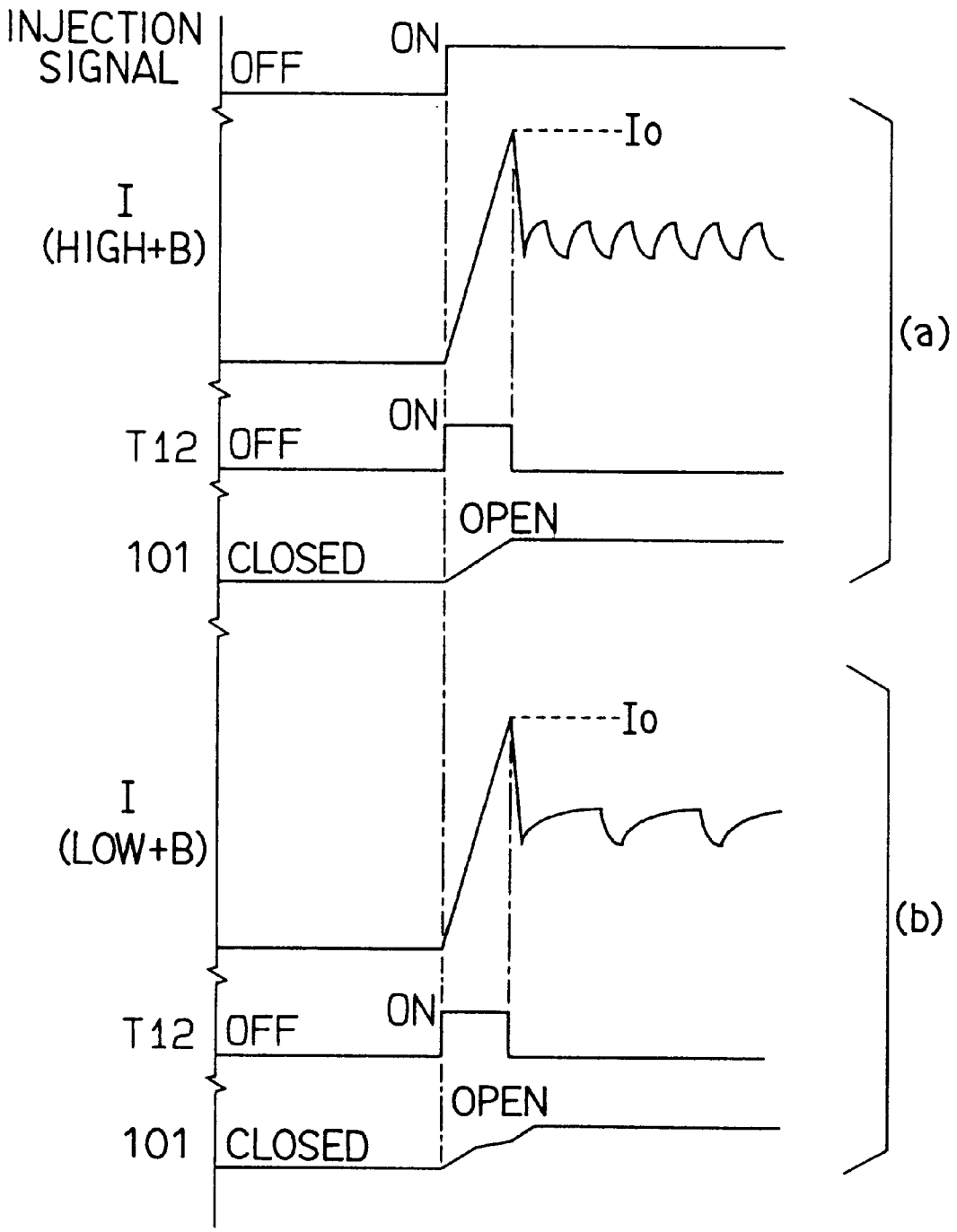
FIG. 11 is a timing diagram showing an operation of the third embodiment when a voltage of a battery drops.

In the case of a low voltage appearing on the power supply line +B of the battery shown in (b) of FIG. 11, on the other hand, the injector current I rises more gradually, shifting the timing to supply energy to a later point of time. Thus, energy is not supplied with a high degree of efficiency. As a result, the opening response of the electromagnetic valve is poor and the injector current I drops at the end of the electrical discharge. In consequence, it is quite within the bounds of possibility that the opened state of the electromagnetic valve cannot be sustained and a desired amount of injection cannot therefore be obtained.

Figure 8:
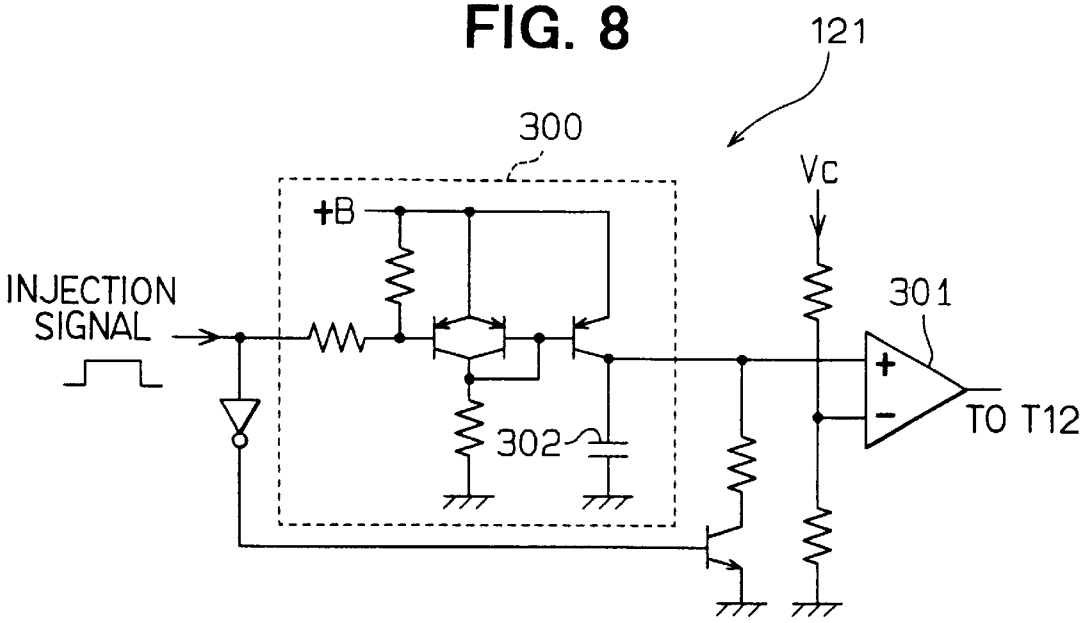
FIG. 8 is a circuit diagram showing a discharging control circuit in a third embodiment of the present invention.
Figure 9:
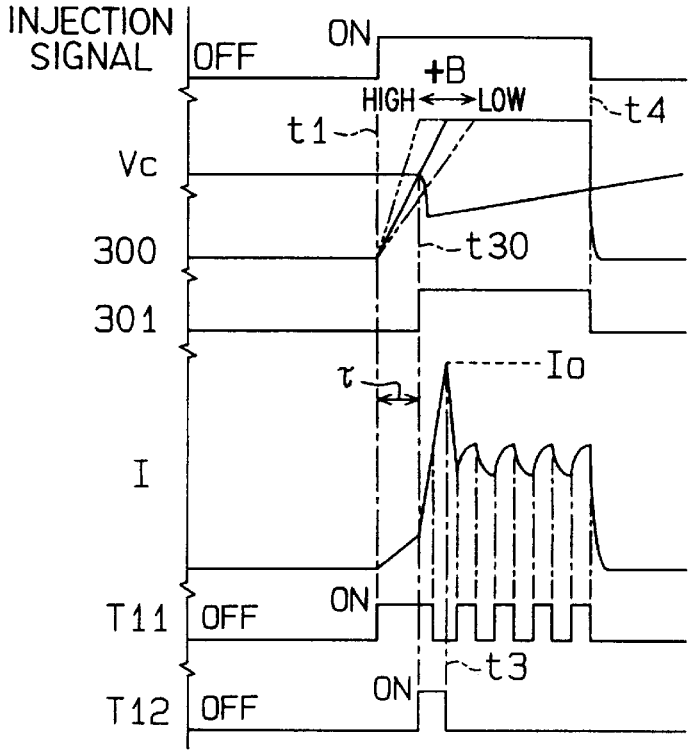
FIG. 9 is a timing diagram showing an operation of the third embodiment.

In the third embodiment, therefore, the discharging control circuit 121 is configured as shown in FIG. 8 to attain the operation shown in FIG. 9. As shown in FIG. 9, the lower the voltage appearing on the power supply line +B of the battery, the longer the period of time by which conduction of the transistor T12 is delayed, that is, by which energy accumulated in the capacitor C10 is supplied to the solenoid 101*a*. This is because the discharging control circuit 121 shown in FIG. 8 supplies energy for speeding up the operating response of the solenoid 101*a* to the solenoid 101*a*. That is, the lower the voltage appearing on the power supply line +B of the battery, the longer the period of time by which the supply of the energy to the solenoid 101*a* is delayed.

In the third embodiment, the ECU 200 shown in FIG. 1 is constructed to monitor the voltage appearing on the power supply line +B of the battery and generate an injection signal #1' in place of injection signal #1. It serves as a reference point to open the electromagnetic valve with such a timing that, the lower the voltage appearing on the power supply line +B of the battery, the earlier the point of time at which the injection signal #1' is generated so that the transistors T10 and T11 are also turned on to start the operation of the solenoid 101*a* at an earlier point of time. That is, the lower the voltage appearing on the power supply line +B of the battery, the earlier the point of time at which the ECU 200 expedites the timing to start the operation of the solenoid 101*a*. That is, the ECU 200 and the driving IC 120 both controls the transistors T10, T11 and T12 to implement characteristic operations of the embodiment.

In the third embodiment, therefore, a capacitor 302 of the ramp circuit 300 shown in FIG. 8 is electrically charged by the power supply line +B of the battery. The gradient of the ramp voltage is determined by the voltage appearing on the power supply line +B of the battery as shown in FIG. 9. Specifically, the lower the voltage appearing on the power supply line +B of the battery, the more lenient the gradient of the ramp voltage.

By configuring the ramp circuit 300 as shown in FIG. 8, the on operation or the start of conduction of the transistor T12 is delayed from the rising edge of injection signal #1 by comparison of the ramp voltage with the voltage Vc of the capacitor C10 by the comparator 301. Since the lower the voltage appearing on the power supply line +B of the battery, the more lenient the gradient of the ramp voltage as described above, the lower the voltage appearing on the power supply line +B of the battery, the longer the period of time by which the on operation or the start of conduction of the transistor T12 is delayed from the rising edge of injection signal #1. By controlling the timing to start the electrical discharge in accordance with the voltage Vc of the capacitor C10 and the voltage appearing on the power supply line +B of the battery as described above, discharged energy can be furnished with an optimum timing.

According to the third embodiment, at a point of time t1 shown in FIG. 9, injection signal #1 is changed to an on-state from an off-state and the transistor T11 also starts conduction of electricity as well so that the current starts to flow from the power supply line +B of the battery as the injector current I. In the case of low voltage Vc of the capacitor C10 and high voltage appearing on the power supply line +B of the battery, however, the transistor T12 also starts conduction of electricity almost at the same time as the time injection signal #1 is changed to an on-state from the off-state. As a result, no current actually flows through the transistor T11.

In addition, the injector current I caused by an electrical discharge of the capacitor C10 made possible by the on-state of the transistor T12 rises sharply, and the conduction of the transistor T12 is then cut off as the injector current reaches a predetermined level of the cut-off current value I0 to stop the electrical discharge of the capacitor C10. As a result, energy is supplied to the injector 101 to open the electromagnetic valve thereof with a high degree of efficiency.

In the case of high voltage Vc of the capacitor C10 and low voltage appearing on the power supply line +B of the battery, on the other hand, as soon as injection signal #1 is changed to an on-state from an off-state, first of all, the transistor T11 starts conduction of electricity so that the current starts to flow from the power supply line +B of the battery as an injector current since the electricity conduction of the transistor T12 is delayed.

Later on, the injector current I caused by the electrical discharge of the capacitor C10 made possible by the on-state of the transistor T12 rises sharply, and the conduction of the transistor T12 is then cut off as the injector current reaches the predetermined level of the cut-off current value I0 to stop the electrical discharge of the capacitor C10.

The high voltage Vc of the capacitor C10 results in a particularly abrupt rising edge of the injector current I. On the other hand, the low voltage appearing on the power supply line +B of the battery delays the time at which the injector current reaches the level of the cut-off current or delays the timing to supply energy from the capacitor C10. Thus, energy is supplied to the injector 101 to open the electromagnetic valve thereof with a high degree of efficiency. As a result, the opening response of the electromagnetic valve can be speeded up in a stable manner without causing the injector current to drop at the end of the electrical discharge.

Figure 10:
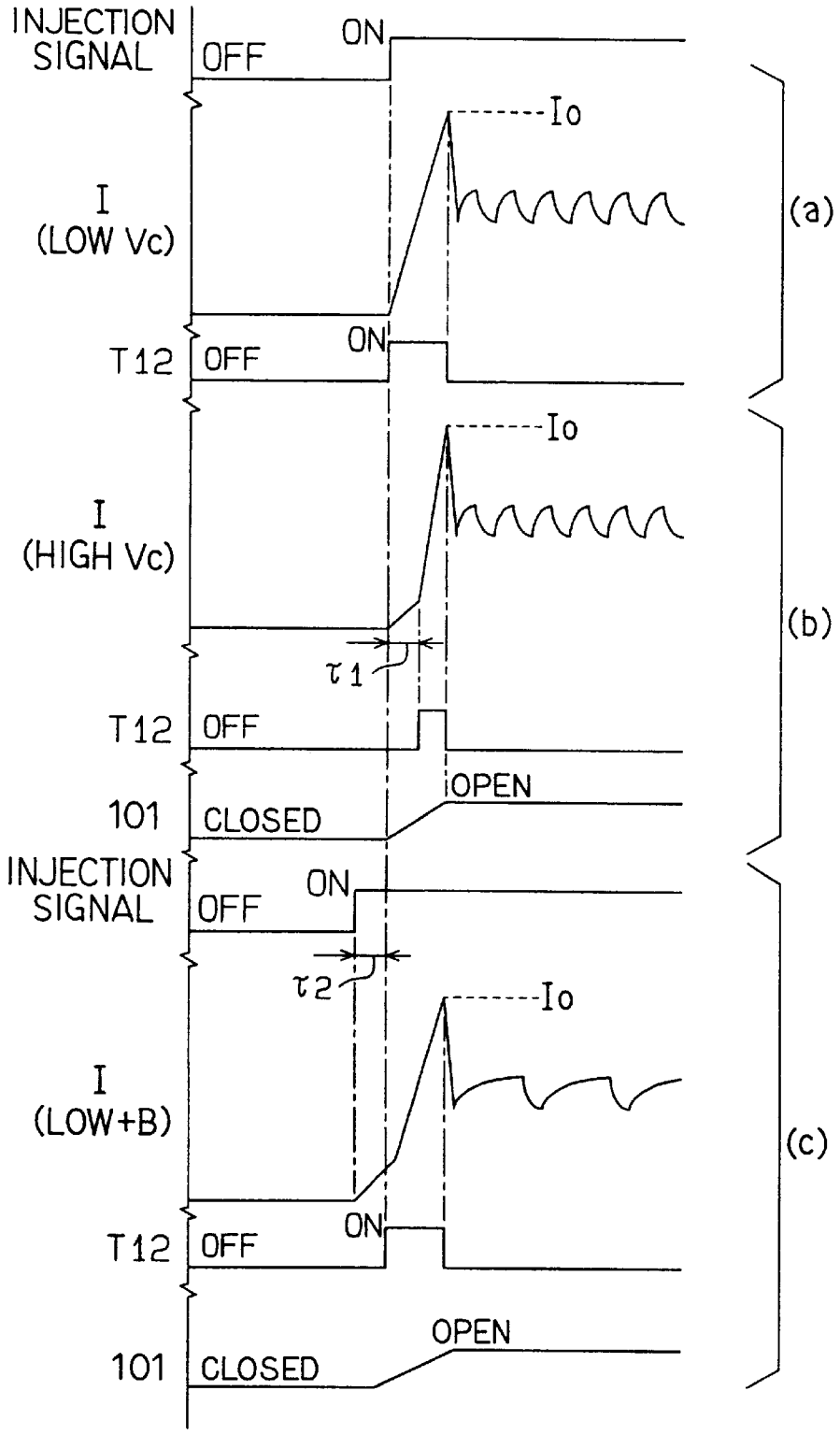
FIG. 10 is a timing diagram showing an operation of the third embodiment.

FIG. 10 shows a process to open the electromagnetic valve with the rising edge of injection signal #1 to open the electromagnetic valve taken as a reference. Specifically, in FIG. 10, (a) shows an operation in the case of low capacitor voltage Vc, (b) shows an operation in the case of high capacitor voltage Vc, and (c) shows an operation in the case of low voltage appearing on the power supply line +B of the battery.

(a) and (b) of FIG. 10 show processes to open the electromagnetic valve with the rising edge of injection signal #1 taken as a reference in the case of a voltage on the power supply line +B of the battery high enough for constant current control. In the case of (b), the conduction of the transistor T12 is delayed from the fixed rising edge of injection signal #1 by a delay time $\tau 1$ so that the opening response of the electromagnetic valve can be speeded up in a stable manner without causing the injector current to drop at the end of the electrical discharge even for high voltage Vc of the capacitor C10. In the case of (c), the delay time $\tau 1$ is further lengthened due to the low voltage on the power supply line +B of the battery.

In order to solve this problem, the ECU 200 monitors the voltage appearing on the power supply line +B of the battery and generates the injection signal #1' with a rising edge preceding the rising edge of injection signal #1 by a period $\tau 2$ which is determined by the level of the voltage appearing on the power supply line +B of the battery in case this voltage is low.

As described above, the timing to supply energy to the injector 101 by the electrical discharge of the capacitor C10 is controlled in accordance with the electrical charging state of the capacitor C10 or the voltage Vc of the capacitor C10 as well as the voltage appearing on the power supply line +B of the battery. As a result, the opening response of the electromagnetic valve can be speeded up and a stable operation of the solenoid 101*a* can be assured even for low voltage appearing on the power supply line +B of the battery. In particular, this is advantageous for a case in which the capacitor C10 is electrically charged to a high voltage with a small amount of energy accumulated in the capacitor C10.

In the third embodiment, the ECU 200 and the driving IC 120 controls the transistors T10, T11 and T12. In the configuration, the discharging control circuit provided as shown in FIG. 8 creates a time delay relative to an injection signal generated by the ECU 200 in a hardware manner. In order to sustain consistent timing to open the electromagnetic valve for a low voltage appearing on the power supply line +B of the battery, the injection signal is expedited in a software manner.

It should be noted, however, that as an alternative, the ECU 200 can be used to control the transistors T10, T11 and T12 to implement characteristic operations of the embodiment. In this alternative configuration, the electrical charging voltage Vc of the capacitor C10 is supplied to the ECU 200 which controls a fixed current by outputting an injection start signal earlier for a drop in voltage appearing on the power supply line +B of the battery, and generates a discharge signal delayed by a period of time depending on the charging voltage Vc of the capacitor C10.

Further, the third embodiment may be so modified that the transistor T12 is driven in the duty ratio control or in the linear operation range based on the capacitor voltage Vc at the time of starting the injection as described with respect to the first embodiment.

Fourth Embodiment

Figure 12:
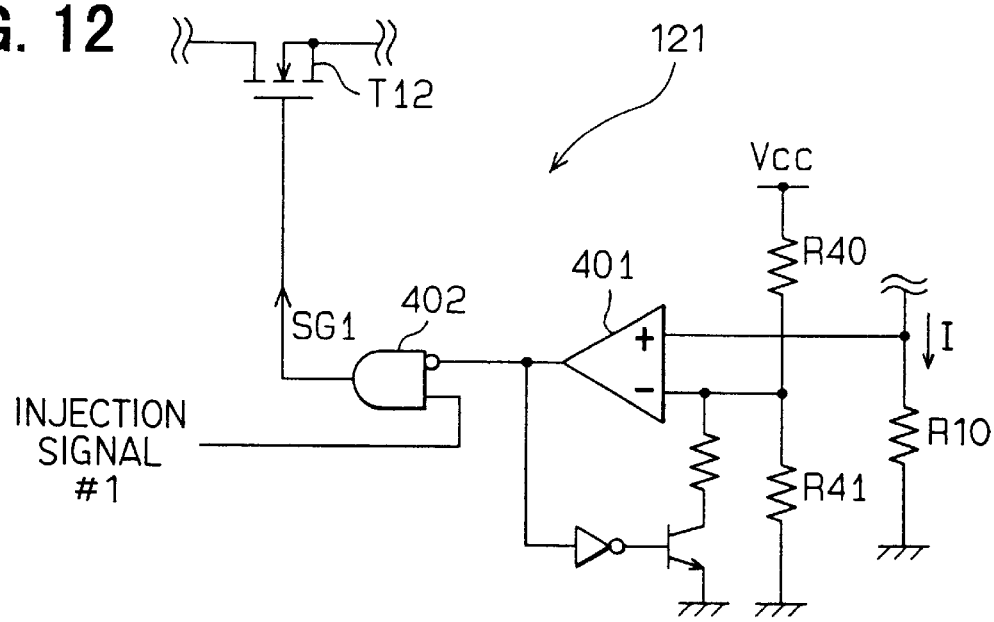
FIG. 12 is a circuit diagram showing a discharging control circuit in a fourth embodiment of the present invention.

A fourth embodiment is directed to a valve closing time control, while the above first to third embodiments are directed to a valve opening time control. The discharging control circuit 121 is configured as shown in FIG. 12.

Specifically, similarly to the second embodiment (FIG. 6), the discharging control circuit 121 comprises the comparator 401. The comparator 401 compares the voltage representing the injector current I flowing through the injector 101 with a comparison voltage output by the potentiometer comprising the resistors R40 and R41 connected to each other in series. The resistors R40 and R41 are connected to a reference voltage Vcc. The comparison voltage represents the level of the cut-off current I0. The output terminal of the comparator 401 is connected to the transistor T12 through the gate 402. At the time the injection signal #1 is applied, the result of comparison output by the comparator 401 turns on the transistor T12 through the gate 402.

Figure 13:
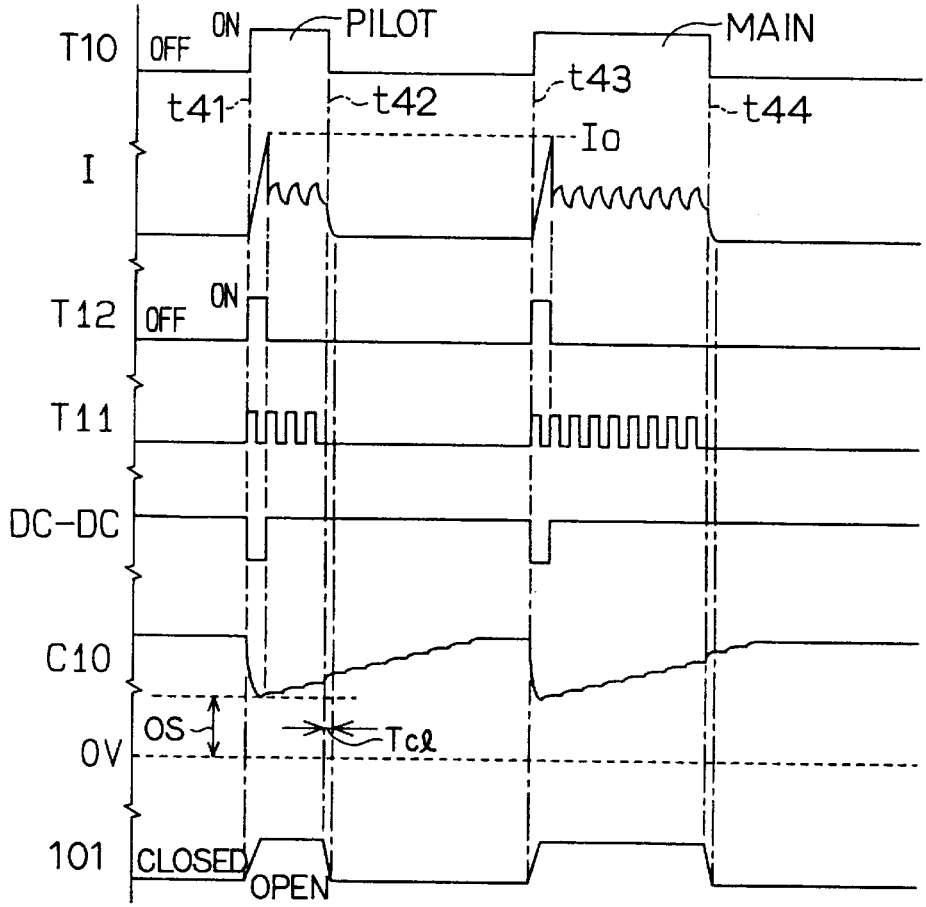
FIG. 13 is a timing diagram showing an operation of the fourth embodiment.

FIG. 13 shows an operation in the case of pilot and main injections. Prior to the pilot injection shown in FIG. 13, the capacitor C10 is electrically charged by the charging control circuit 110 to the fully charged state. After energy required for speeding up the opening response of the electromagnetic valve is discharged, the voltage of the fully charged state drops to a voltage not lower than a predetermined level of the offset voltage set to remain in the capacitor C10. The offset voltage is set at such a predetermined level that the valve closing time Tcl shown in FIG. 13 is constrained within an allowable range. This offset is provided by determining the capacitance of the capacitor C10 to be large enough. The valve closing time Tcl is a switching time of the valve from an opened state to a closed state. To be more specific, the valve closing time Tcl is a time required by the valve to switch the operating state thereof from an opened state to a closed state at the solenoid turning-off time, that is, at the end of the injection signal #1 at which time the transistor T10 turns off.

When the injection signal (transistor T10) is turned on, rising to the logically high level at a point of time t41 after the capacitor C10 has been put in the fully charged state, the transistors T10 and T12 are turned on to start the injection by the injector 101. The transistor T11 is also turned on and driven in the duty ratio control manner. With the transistor T12 turned on, the injector current detection resistor R10 monitors the injector current I flowing through it. As the magnitude of the detected injector current I reaches the predetermined level I0, the transistor T12 is turned off by the discharging control circuit 121 employed in the driving IC 120. This is because the predetermined energy required for one injection is considered to have been discharged from the capacitor C10 or the voltage Vc of the capacitor C10 is considered to have dropped to the level at which discharging the required energy is completed.

As described above, the transistor T12 is turned on only during the fixed period at the beginning of the injection to discharge energy accumulated in the capacitor C10 to the injector 101. In this way, a large current flows through the solenoid 101*a* of the injector 101, speeding up the valve opening response of the injector 101. At that time, in order to stabilize the current discharged from the capacitor C10, the electrical charging operation by means of the DC-DC converter circuit 50 is inhibited while the transistor T12 is conducting.

After energy has been discharged from the capacitor C10, that is, after the operation to supply energy has been ended in this way, the transistor T11 is subsequently controlled to turn on and off, flowing the constant current through the solenoid 101*a* employed in the injector 101 by way of the diode D11. That is, the driving IC 120 turns the transistor T11 on and off in accordance with the magnitude of the driving current (or the injector current I) detected by the injector current detection resistor R10 to maintain the driving current at the predetermined value. As a result, the valve of the injector 101 is kept in an opened state.

Later on, when injection signal is turned off at a point of time t42, the transistor T10 is also turned off to close the valve of the injector 101, hence, terminating the injection by the injector 101. When the injector current I of the injector 101 is cut off, energy of the counter-electromotive force is restored to the capacitor C10 by way of the diode D10. At that time, the energy is recovered by the capacitor C10 from which energy was discharged at the beginning of the injection. After that, the operation to turn the transistor T00 on and off is started to electrically charge the capacitor C10 by using the DC-DC converter circuit 50.

Thereafter, the main injection based on the injection signal is carried out during a period of time between points of time t43 and t44 as shown in FIG. 13. The main injection is carried out in the same way as the pilot injection. Since the interval between the injections is short, electrical charging by the DC-DC converter circuit 50 is started right away upon completion of the electrical discharging. The voltage Vc of the capacitor C10 varies in dependence on changes in injection period. Since the offset is provided in the voltage Vc of the capacitor C10, however, the valve closing time Tcl, that is, a variation in time required by the injector current I to drop, can be reduced to a negligible magnitude.

Figure 14:
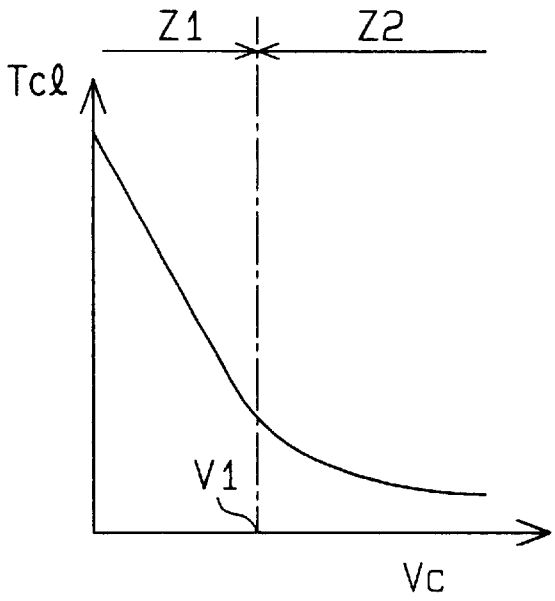
FIG. 14 is a graph showing a relation between a voltage of a capacitor at the end of an injection and a valve closing time of an injector current I the fourth embodiment.
Figure 15:
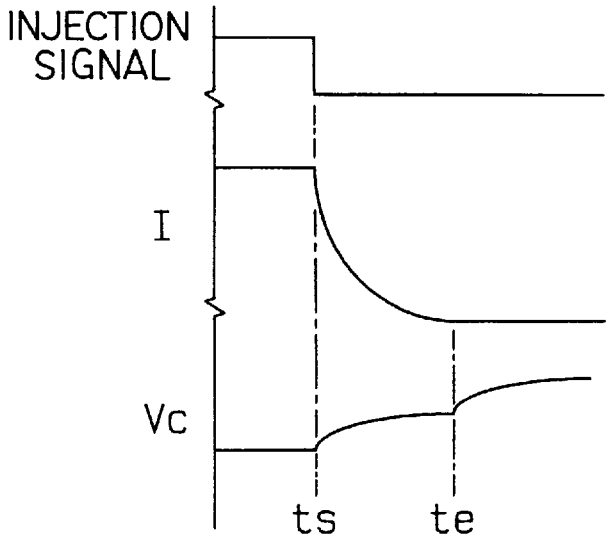
FIG. 15 is a timing diagram showing a current of an injector and the voltage of the capacitor at the end of an injection in the fourth embodiment.

FIG. 14 shows a relation between the capacitor voltage Vc of the capacitor C10 observed at the end of the injection and the valve closing time Tcl of the injector 101. FIG. 15 shows signal waveforms of the injector current I and the voltage Vc of the capacitor C10 which are observed after the injection is completed. At a point of time ts shown in FIG. 15, the current flowing through the injector is cut off. At that time, energy of counter-electromotive force across the injector 101 is recovered by the capacitor C10. Then, at a point of time te, a current flowing through the inductor L00 employed in the DC-DC converter circuit 50 is cut off. At that time, energy of the counter-electromotive force developed across the inductor L00 is recovered by the capacitor C10. Thus, at the points of time ts and te, the voltage Vc of the capacitor C10 increases.

In this case, energy E accumulated in the solenoid 101*a* of the injector 101 can be expressed as follows with $I_{INJ}$ representing the injector current:

$$E=\int_{ts}^{te} VC \cdot I_{INJ} dt$$

Since the current is controlled to accumulate energy of a fixed amount in the solenoid 101*a*, the higher the voltage Vc, the shorter the valve closing time Tcl as shown in FIG. 14. That is, for the voltage Vc lower than the predetermined level V1 in an area Z1, the valve closing time Tcl greatly varies with a change in the capacitor voltage Vc. For the voltage Vc higher than the predetermined level V1 in an area Z2, on the other hand, the valve closing time Tcl varies only slightly with a change in the capacitor voltage Vc.

By providing the offset to the voltage Vc, it is thus possible to electrically charge and discharge the capacitor C10 in the area Z2 where differences in valve closing time Tcl are negligible so as to suppress variations in valve closing time Tcl.

It should be noted that the electrical charging and discharging control is also effective for a case in which energy required for a plurality of injections is accumulated in the capacitor C10 for multi-stage and multi-cylinder injections.

Figure 16:
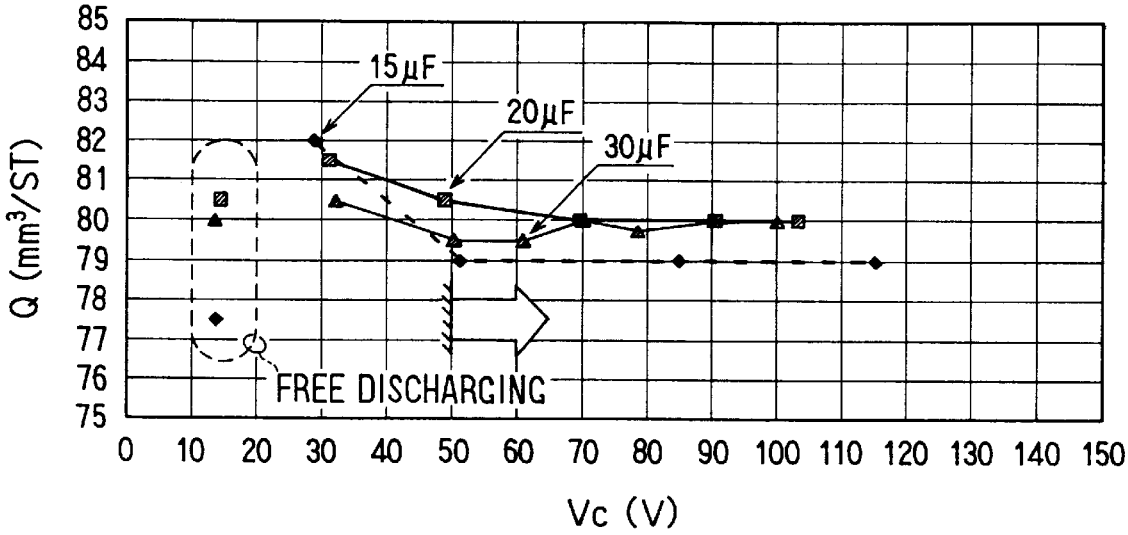
FIG. 16 is a graph showing experiment results indicating a relation between the capacitor voltage and a fuel injection amount.
Figure 17:
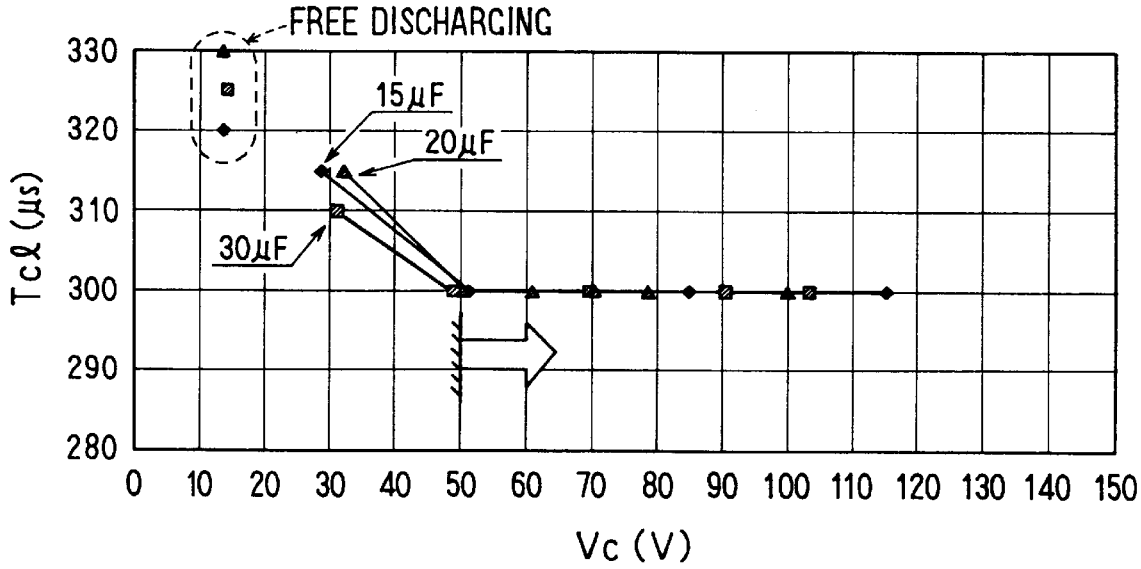
FIG. 17 is a graph showing experiment results indicating a relation between the capacitor voltage and a valve closing time.

According to experiment conducted with respect to the fourth embodiment, the injection amount Q and the valve closing time Tcl were measured with respect to capacitance (15 μF, 20 μF and 30 μF) of the capacitor C10 and the capacitor voltage Vc at the time of energy recovery. In this experiment, the battery voltage was 14 V, the injection period was set to 1.0 ms and the fuel pressure was set to 135 MPa. As understood from the experiment results shown in FIGS. 16 and 17, the valve closing time Tcl can be maintained substantially at a constant time as long as the offset voltage is above 50 V.

In the fourth embodiment, the transistor T12 is assumed to turn on at the beginning of the injection signal (turning-on of the transistor T10) as shown in FIG. 13. However, the transistor T12 may be turned on with a delay τ after the beginning of the injection signal in the same manner as in the first to third embodiments.

Fifth Embodiment

A fifth embodiment is directed to a case in which a plurality of injectors are grouped and controlled from group to group.

Figure 18:
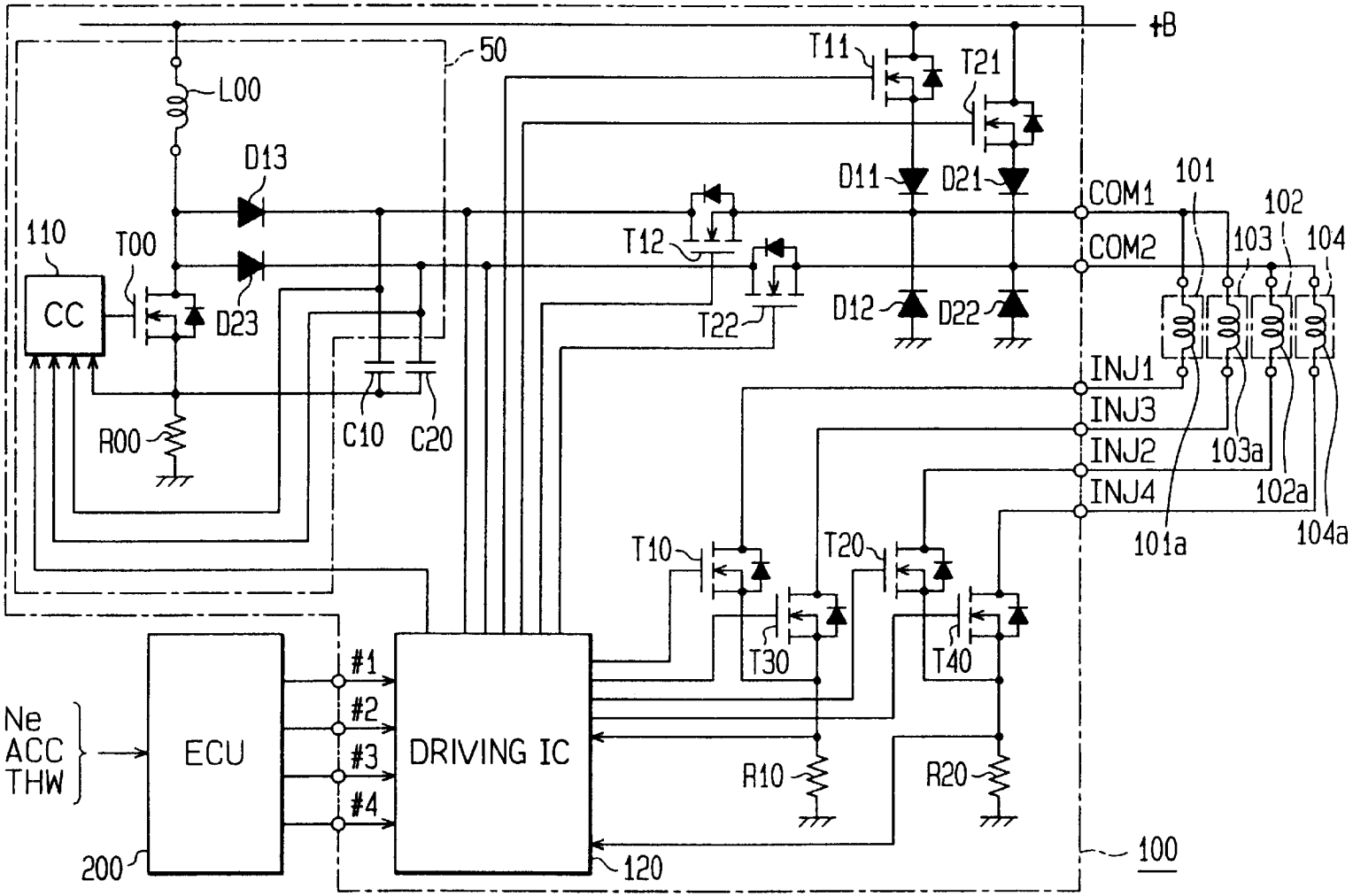
FIG. 18 is a circuit diagram showing an injector control apparatus according to a fifth embodiment of the present invention.

As shown in FIG. 18, the injector control apparatus comprises four injectors 101, 102, 103 and 104 for injecting fuel to respective cylinders. The injectors 101, 102, 103 and 104 respectively have a solenoid 101*a*, a solenoid 102*a*, a solenoid 103*a* and a solenoid 104*a* which each serve as an electrical load. The injectors 101 to 104 for four cylinders are divided into two injection groups each for handling two cylinders. The first injection group connected to a common terminal COM1 of the driving circuit 100 comprises the injectors 101 and 103. On the other hand, the second injection group connected to a common terminal COM2 of the driving circuit 100 comprises the injectors 102 and 104.

It should be noted that the two injectors pertaining to the same injection group are not driven at the same time. Design specifications of the engine determine, among other things, which cylinders in the injection groups are to be driven in multi-cylinder injections.

In addition to the circuit construction shown in FIG. 1 (first embodiment), the junction between the inductor L00 and the transistor T00 is connected to one end of a capacitor C20 serving as an energy accumulation device through a diode D23 used for blocking a reversed current while the other end of the capacitor C20 is connected to the junction between the transistor T00 and the resistor R00.

It should be noted that the capacitor C10 is dedicated to the first injection group which is connected to the common terminal COM1 for the injectors 101 and 103. On the other hand, the capacitor C20 is dedicated to the second injection group which is connected to the common terminal COM2 for the injectors 102 and 104. In this arrangement, the solenoids of injectors which may possibly driven at the same time are connected to different capacitors while injectors never driven at the same time are put in the same injection group to share the same capacitor.

The inductor L00, the transistor T00, the charging current detection resistor R00, the charging control circuit 110 and the diodes D13 and D23 form the DC-DC converter circuit 50 which serves as the voltage raising circuit. By turning the transistor T00 on and off, each capacitor C10 and C20 can be electrically charged through each diode D13 and D23. As a result, the capacitors C10 and C20 can each be electrically charged to a voltage higher than the voltage appearing on the power supply line +B of the battery.

The driving IC 120 inputs each injection signal #1, #2, #3, and #4 of cylinder #1, #2, #3, and #4 (that is, the first to fourth cylinders), from the ECU 200 through each input terminal #1, #2, #3, and #4. Although not shown in FIG. 18, the driving IC 120 includes discharging control circuits for the transistors T12 and T22. Each discharging control circuit may be constructed as shown in the foregoing embodiments, particularly as shown in the fourth embodiment (FIG. 12).

The transistor T12 is temporarily turned on at a timing of inversion of injection signal #1 or #3 from the off-state (logically low level) to the on-state (logically high level), supplying energy accumulated in the capacitor C10 to the injector 101 or 103 in the electrical discharging operation. Specifically, the transistor T12 is provided between the capacitor C10 and the common terminal COM1. When the transistor T12 is turned on by the driving IC 120, energy accumulated in the capacitor C10 is supplied to the injector 101 or 103 through the common terminal COM1.

Similarly, a transistor T22 is temporarily turned on at a timing of inversion of injection signal #2 or #4 from the off-state (logically low level) to the on-state (logically high level), supplying energy accumulated in the capacitor C20 to the injector 102 or 104 in an electrical discharging operation. Specifically, the transistor T22 is provided between the capacitor C20 and the common terminal COM2. When the transistor T22 is turned on by the driving IC 120, energy accumulated in the capacitor C20 is supplied to the injector 102 or 104 through the common terminal COM2.

The low side end of each injector 101, 102, 103, and 104 is connected to each transistor T10, T20, T30, and T40 through each terminal INJ1, INJ2, INJ3, and INJ4 of the driving circuit 100. When each injection signal #1, #2, #3, and #4 received from the ECU 200 is set to the logically high level, each transistor T10, T20, T30, and T40 is turned on. The transistors T10 and T30 are connected to the ground through the injection current detection resistor R10. Similarly, the transistors T20 and T40 are connected to the ground by an injection current detection resistor R20.

In this embodiment, the resistor R10 and the driving IC 120 are provided for detecting the quantity of energy supplied by the capacitor C10 to the solenoid 101*a* or 103*a*. Similarly, the resistor R20 and the driving IC 120 are provided for detecting the quantity of energy supplied by the capacitor C20 to the solenoid 102*a* or 104*a*.

Each common terminal COM1 and COM2 is also connected to the power supply line B+of the battery by each diode D11 and D21, and each transistor T11 and T21, respectively. The driving IC 120 turns each transistor T11 and T21 on and off in accordance with the magnitude of the driving current flowing through the injector 101, 102, 103, or 104. As a result, a constant current is supplied to the injector 101, 102, 103, or 101 from the power supply line +B. Each diode D12 and D22 serves as a feedback diode. When each transistor T11 and T21 is turned off, a current flowing through the injector 101, 102, 103, or 104 is fed back through the diode D12 or D22.

In actual operation, each transistor T12 and T22 is turned on at the rising edge of injection signal #1, #2, #3, or #4 which serves as a driving command. At that time, energy is discharged from each capacitor C10 and C20, causing a large current to flow from each capacitor C10 and C20 to the injector 101, 102, 103, or 104 as a current driving the respective injectors. Then, on the falling edge of the injection signal, the driving current is cut off but a fixed current is supplied through each transistor T11 and T21. It should be noted that each diode D11 and D21 prevents a current from flowing to the power supply line +B from the terminal COM1 which is raised to a high electrical potential when the energy is discharged from each capacitor C10 and C20.

The capacitors C10 and C20 employed in this embodiment are each capable of storing energy required for opening the valve several times in advance. Specifically, the capacitors C10 and C20 each have a high fully charged voltage or a large capacity. Assume that energy of 50 mJ needs to be discharged from the capacitor C10 or C20 for one injection. In this case, in order to store energy required for three consecutive injections in the capacitor C10 or C20, for a fixed capacity of 10 $\mu$F, the capacitor voltage needs to be increased to 173 V relative to 100 V and, for a fixed capacitor voltage of 100 V, the capacity needs to be increased to 30 $\mu$F relative to 10 $\mu$F.

In this embodiment, the transistors T10, T20, T30 and T40 function as first energy supply device for supplying energy of the battery power supply to the solenoids 101*a*, 102*a*, 103*a* and 104*a*, respectively. On the other hand, the transistor T12 functions as the second energy supply device for supplying energy accumulated in the capacitor C10 to the solenoid 101*a* or 103*a*. Similarly, the transistor T22 also functions as the second energy supply device for supplying energy accumulated in the capacitor C20 to the solenoid 102*a* or 104*a*.

Figure 19:
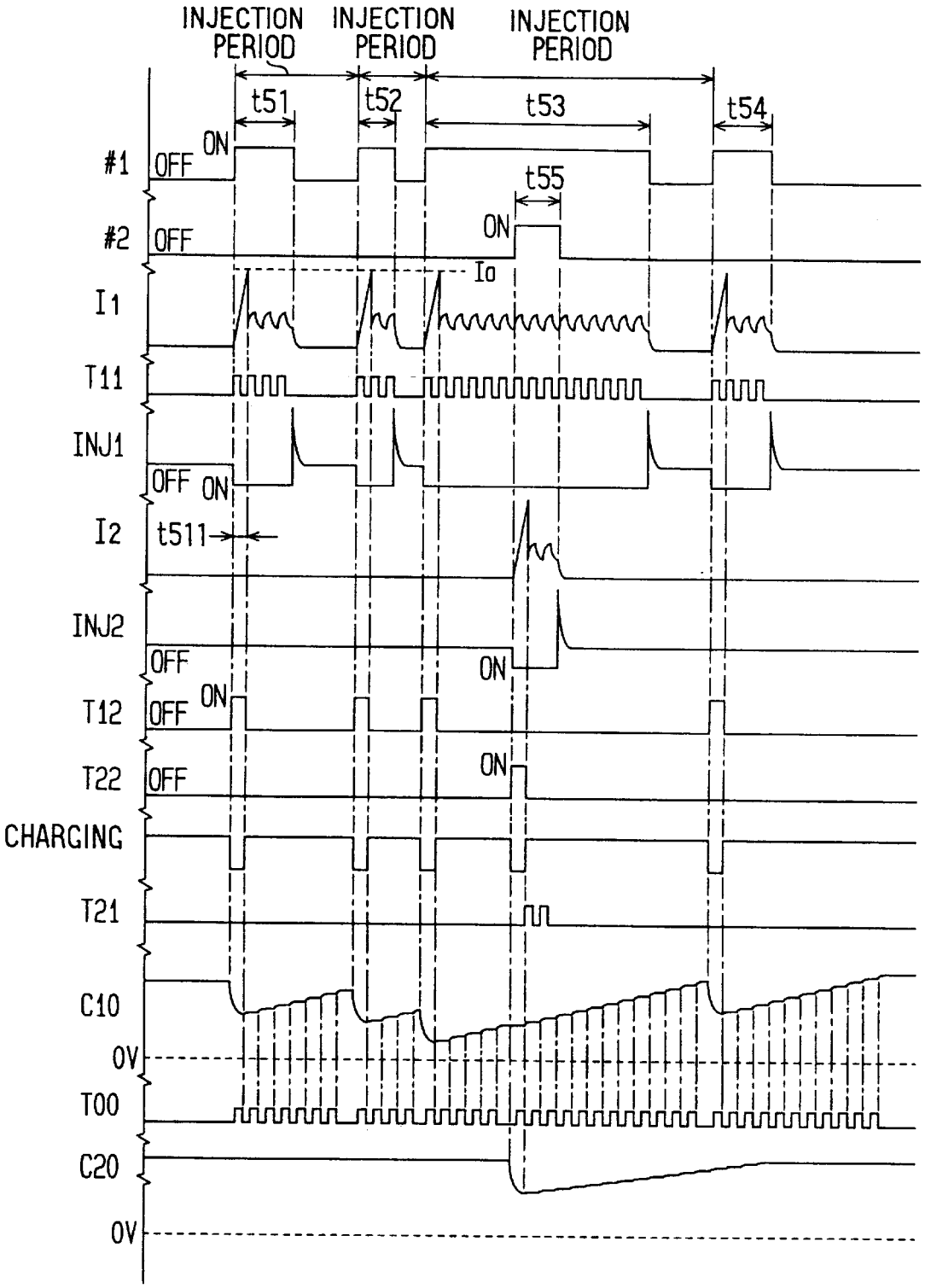
FIG. 19 is a timing diagram showing an operation of the fifth embodiment.

FIG. 19 shows typical operations in multi-stage and multi-cylinder injections. In this case, the multi-stage injections are exemplified by injections before and after a main injection. The injections preceding a main injection are a pre-injection and a pilot injection, whereas the injections succeeding the main injection are an after-injection and a post-injection. The pre-injection is carried out mainly for activation inside a cylinder. The pilot injection is carried out mainly for reducing the amount of NOx and reducing the amount of combustion sound. The after-injection is carried out mainly for re-combustion of soot. The post-injection is carried out mainly for activation of a catalyst (not shown). That is, these injections are intended for improving exhaust emission and hence carried out in accordance with, among other conditions, the operating state of the engine.

In FIG. 19, the injection signal #1 is for the first cylinder or cylinder #1 and the injection signal #2 is for the second cylinder or cylinder #2 which is in the separate group from the group of the cylinder #1. In the multi-stage injections of the first cylinder, the pre-injection, the pilot injection, the main injection and the after-injection are carried out in periods of time t51, t52, t53 and t54, respectively . In a period of time t55 within the period of time t53 for the main injection of the first cylinder, the post-injection is carried out for the second cylinder. In the four-cylinder engine, typically, injection signals #1 are generated within 180 degrees CA (crankshaft angle) for triggering the pre-injection, the pilot injection, the main injection and the after-injection of multi-stage injections. The injection signal #2 is generated for the post-injection concurrently with the injection signal #1. The post-injection in the second cylinder forms the multi-cylinder injection relative to the main injection in the first cylinder.

Prior to the pre-injection shown in FIG. 19, the capacitors C10 and C20 are each fully charged by the DC-DC converter circuit 50. Then, when the injection signal #1 is turned on, rising to the logically high level during the period t51, the transistors T10 and T12 are turned on to start the pre-injection by the injector 101. The transistor T11 is duty-controlled by the driving IC 120. As the injector current I1 of the injector 101 reaches the predetermined level I0 after the transistor T12 has been turned on, the transistor T12 is turned off since the predetermined energy required for the first injection is considered to have been supplied to the injector 101. In this way, the transistor T12 is put in the conductive state only during a period of time t511 after the beginning of the pre-injection until the injector current I1 reaches the predetermined cut-off level I0. Thus, the energy accumulated in the capacitor C10 is discharged to the injector 101. As a result, a large current flows through the solenoid 101*a* employed in the injector 101, speeding up the valve opening response of the injector 101.

As described above, in this embodiment, as a technique to control energy discharged from the capacitor C10, the discharged current in the energy discharging is monitored by using the resistor R10. Similarly, as a technique to control energy discharged from the capacitor C20, the discharged current in the energy discharging is monitored by using the resistor R20. As the magnitude of the monitored current reaches the predetermined current level I0, the transistor T22 is turned off.

After the energy discharging operation of the capacitor C10, the transistor T11 is continued to be turned on and off to supply the constant current to the injector 101 by way of the diode D11. That is, the transistor T11 is turned on and off by the driving IC 120 in accordance with the detected magnitude of the injector current I1 by the resistor R10. The injector current I1 can thus be regulated to the constant magnitude. The injector 101 is kept in the valve opening state. In this way, in a joint operation of the transistors T10 and T11 controlled by the driving IC 120, the energy of the battery power supply is supplied to the solenoid 101*a* only during the operation period of the solenoid 101*a*.

As injection #1 is turned off later on, the transistor T10 is also turned off to close the valve of the injector 101. At that time, the pre-injection by the injector 101 is ended. The energy of the counter-electromotive force, which is generated when the current flowing through the injector 101 is cut off, is dissipated in the transistor T10.

If an operation to turn the transistor T00 on and off is started after the energy discharging operation of the capacitor C10, an operation to electrically charge the capacitor C10 by means of the DC-DC converter circuit 50 is also commenced. It should be noted that, in order to stabilize the current discharged from the capacitor C10, the electrical charging operation by means of the DC-DC converter circuit 50 is inhibited while the transistor T12 is conducting. That is, the operation to turn the transistor T00 on and off is inhibited while the transistor T12 is turned on. Thus, the operation to electrically charge the capacitor C10 by means of the DC-DC converter circuit 50 is not carried out while energy is being supplied from the capacitor C10 to the solenoid 101*a* or 103*a*. Similarly, the operation to electrically charge the capacitor C20 by means of the DC-DC converter circuit 50 is not carried out while energy is being supplied from the capacitor C20 to the solenoid 102*a* or 104*a*.

Subsequently, the next injection (that is, the pilot injection) is carried out. At that time, an operation to electrically charge the capacitor C10 by means of the DC-DC converter circuit 50 is conceivably underway after the energy discharging operation of the capacitor C10. Since the energy of an amount large enough for opening the valve a plurality of times has been accumulated in the capacitor C10 in advance, nevertheless, this pilot injection can be accomplished by carrying out operations under the same control as the preceding injection. Other injections such as the main injection can also be performed in the same way.

It should be noted that operations to electrically charge the capacitors C10 and C20 are carried out by means of the DC-DC converter circuit 50 between injections in the multi-stage and multi-cylinder injections as described above. Thus, it is not necessary to accumulate energy for five injections in advance. Therefore, by consideration of periods between injections shown in FIG. 19 and the charging power of the DC-DC converter circuit 50, a capacitor with a capacity large enough for accumulating energy only for two to three injections at its fully charged state is acceptable. For this reason, a capacitor having a small size can be employed.

After the pre-injection in the period of time t51, similar operations for the pilot injection, the main injection and the after-injections are carried out in the periods of time t52, t53 and t54, respectively. That is, when injection signal #1 is turned on, energy accumulated in the capacitor C10 is discharged to the injector 101 at the beginning of each of the periods. Subsequently, the constant current is supplied to the injector 101. Later on, when the injection signal #1 is turned off, the injection by the injector 101 is ended. Then, the operation to electrically charge the capacitor C10 is carried out by means of the DC-DC converter circuit 50.

Next, multi-cylinder injections are explained. As shown in FIG. 19, the injection signal #2 for the post-injection in the period of time t55 is generated to drive the injector 102 while the injection signal #1 for the main injection is generated in the period of time t53 to drive the injector 101. Since the injectors 101 and 102 pertain to different injection groups, they can be controlled independently of each other. Thus, the injections of fuel can be accomplished without the injectors 101 and 102 affecting each other even if their injection periods t53 and t55 overlap.

Specifically, when the injection signal #2 rises to a high level at the start of the period t55, the transistors T20 and T22 are turned on to drive the injector 102 to start the post-injection in the second cylinder. As the transistor T22 is turned on, energy accumulated in the capacitor C20 is discharged to the injector 102. As a result, a large current flows through the solenoid 102*a* employed in the injector 102, speeding up the valve opening response of the injector 102. Following the energy discharging operation of the capacitor C20, the transistor T21 is controlled to turn on and off to supply the constant current to the injector 102 by way of the diode D21 in accordance with the magnitude of the injector current I2 detected by the resistor R20. As a result, the injector 102 sustains its valve in an opened state.

When injection signal #2 is turned off later on, the transistor T20 is also turned off to close the valve of the injector 102. Thus, the post-injection by the injector 102 is finished. The energy of the counter-electromotive force, which is generated when the current flowing through the injector 102 is cut off, is dissipated in the transistor T20.

Much like the capacitor C10 described above, the electrical charging operation of the capacitor C20 by means of the DC-DC converter circuit 50 is inhibited while the transistor T22 is conducting. If the operation to turn the transistor T00 on and off is started after the energy discharging operation of the capacitor C20, the operation to electrically charge the capacitor C20 by means of the DC-DC converter circuit 50 is also commenced.

As described above, for the injection signal #1, the capacitor C10 dedicated to the terminal COM1 is used and, for the injection signal #2, the capacitor C20 dedicated to the terminal COM2 is used and controlled independently of the injection signal #1. Thus, multi-cylinder injections can be carried out.

The above description explains multi-stage injections of cylinder #1 and multi-cylinder injections of cylinders #1 and #2 during the period of 180 degrees CA of the four-cylinder engine. It should be noted, however, that multi-stage and multi-cylinder injections of the other cylinders can be carried out by executing the same control.

As described above, the embodiment has the following characteristics.

(A) In order to carry out the multi-stage injections, the injector control apparatus employs each capacitor C10 and C20 for accumulating energy of an amount large enough for at least two operations of the solenoid 101*a*, 102*a*, 103*a*, or 104*a*. The driving IC 120 controls each transistor T12 and T22 to supply energy required for each operation of the solenoid 101*a*, 102*a*, 103*a*, or 104*a* from the capacitor C10 or C20 to the respective solenoids by monitoring the amount of supplied energy by means of the resistor R10 or R20. Specifically, the energy is used for speeding up the response of the respective solenoids to the operation to drive the injectors, respectively. That is, each capacitor C10 and C20 discharges energy of a quantity required for speeding up the response of the solenoid 101*a*, 102*a*, 103*a*, or 104*a* to the driving operation to open the electromagnetic valve of the respective solenoids in one injection. Thus, by accumulating energy sufficient for a plurality of injecting operations in each capacitor C10 and C20 in advance, multi-stage injections based on the respective capacitors can be carried out.

(B) In addition, to carry out multi-cylinder injections, a plurality of the injector solenoids, that is, the solenoids 101*a*, 102*a*, 103*a* and 104*a*, are grouped so that solenoids never driven at the same time are put in the same group which is furnished with energy from either the capacitor C10 or the capacitor C20. In this way, the number of capacitors can be reduced. As a result, energy can be used with a high degree of efficiency. That is, only one capacitor is used for each cylinder group to satisfy injection requirements.

It should be noted that cylinders are divided into two groups as one of injection requirements. Thus, in the four-cylinder engine, for example, each group comprises two injectors associated with two electromagnetic valves, respectively, as is the case with this embodiment. In the case of a six-cylinder engine, each group comprises three injectors associated with three electromagnetic valves, respectively. In either case, each injector or each of electromagnetic valves pertaining to the same group can be used to carry out multi-stage injections. On the other hand, multi-cylinder injections involve cylinders pertaining to different groups.

Sixth Embodiment

Figure 20:
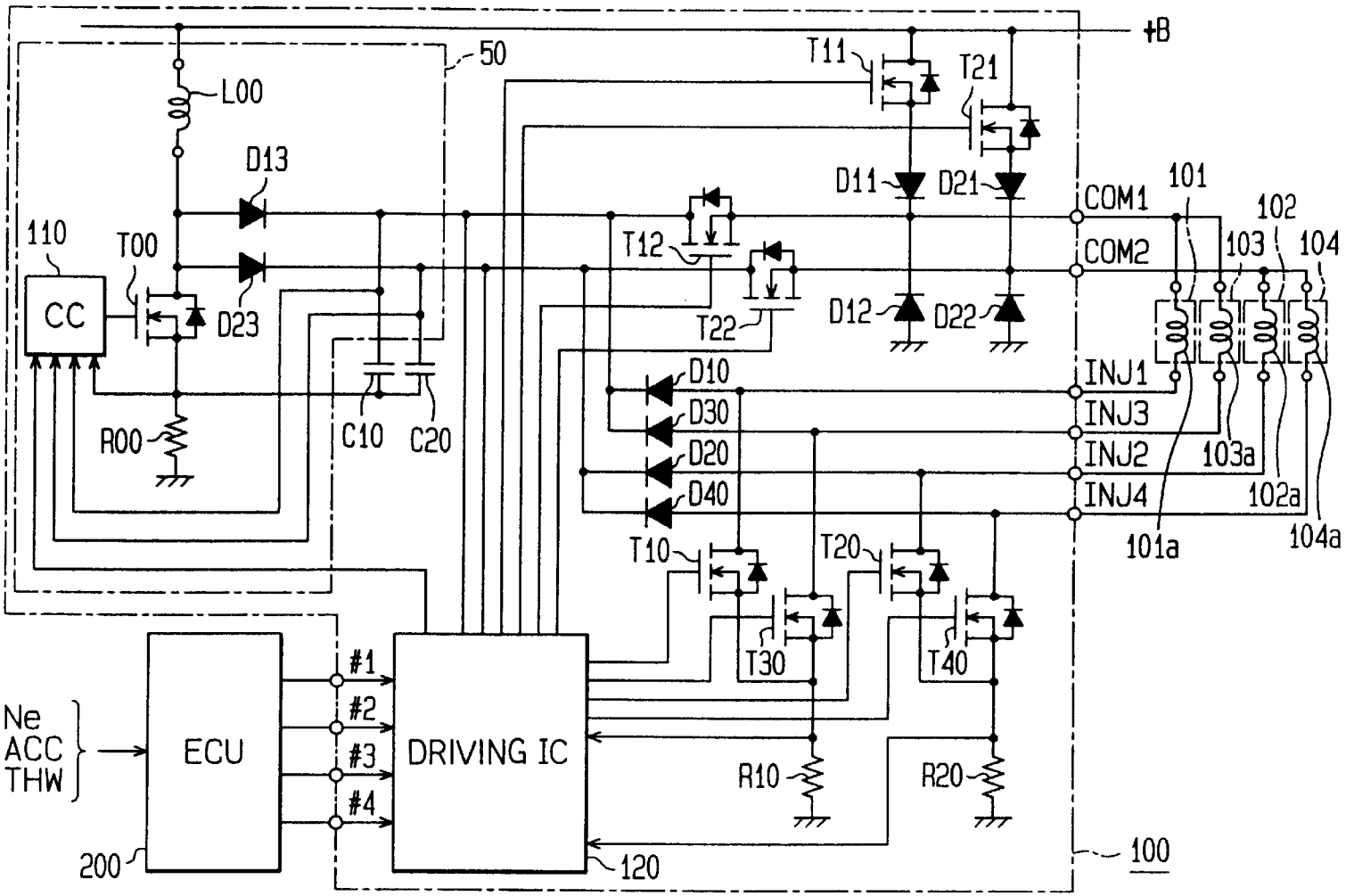
FIG. 20 is a circuit diagram showing an injector control apparatus according to a sixth embodiment of the present invention.

In a sixth embodiment, as shown in FIG. 20, the injectors 101 to 104 are connected to the capacitors C10 and C20 through diodes D10 to D30, respectively. Specifically, the injectors 101 and 103 pertaining to the same injection group are connected to the capacitor C10 trough the diodes D10 and D30 respectively. The energy of the counter-electromotive force or the fly-back energy, which is generated when the current flowing through the injector 101 or 103 is cut off, is recovered to the capacitor C10 by way of the diode D10 or D30, respectively.

Similarly, the injectors 102 and 104 pertaining to the other injection group are connected to the capacitor C20 by the diodes D20 and D40, respectively. The energy of the counter-electromotive force or the fly-back energy, which is generated when the current flowing through the injector 102 or 104 is cut off, is recovered to the capacitor C20 by way of the diode D20 or D40 respectively.

While the above embodiments are implemented as a system for controlling injectors of a diesel engine, the present invention can also be applied to a control system for a gasoline engine. Further, the electrical loads may be a capacitive-type which uses piezoelectric devices.

What is claimed is:

1. An electrical load control apparatus comprising:

an electrical load;

energy accumulation means connected to the electrical load for accumulating energy to be supplied to the electrical load; and control means for driving the electrical load by using energy accumulated in the energy accumulation means, wherein the control means detects a voltage of the energy accumulation means at the time of starting to drive the electrical load, and controls a current flowing in the electrical load in accordance with the detected voltage, the current being for operating the electrical load; and the control means delays more a timing to start supplying the accumulated energy from a timing of starting an operation of the electrical load, as the detected voltage increases.

2. An electrical load control apparatus comprising:

an electrical load;

energy accumulation means connected to the electrical load for accumulating energy to be supplied to the electrical load; and control means for driving the electrical load by using energy accumulated in the energy accumulation means, wherein the control means detects a voltage of the energy accumulation means at the time of starting to drive the electrical load, and controls a current flowing in the electrical load in accordance with the detected voltage; and the control means supplies energy of a vehicle-mounted power supply to the electrical load during an operation period of the electrical load by using first energy supplying means, and supplies the accumulated energy for speeding up an operating response of the electrical load to the electrical load at a timing variable with the detected voltage of the energy accumulation means by using second energy supplying means.

3. The control apparatus as in claim 2, wherein:

the control means starts supplying the accumulated energy to the electrical load at a start of an operation period of the electrical load and stops supplying the accumulated energy as the detected current flowing through the electrical load reaches a predetermined level; and the predetermined level is set higher, as the detected voltage increases.

4. The control apparatus as in claim 3, wherein:

the control means stops supplying the accumulated energy to the electrical load after a fixed period of time has lapsed from the start of supplying the accumulated energy.

5. The control apparatus as in claim 2, wherein:

the control means executes a constant current supply from the power supply to the electrical load after stopping supplying the accumulated energy from the energy accumulation means to the electrical load.

6. The control apparatus as in claim 2, wherein:

the control means determines the variable timing in accordance with a voltage of the power supply, and advances a timing of operation of the electrical load as the detected voltage of the power supply decreases.

7. The control apparatus as in claim 2, further comprising:

voltage raising means for raising the voltage of the energy accumulation means to be higher than the voltage of the power supply.

8. The control apparatus as in claim 2, further comprising:

energy recovery means for recovering a fly-back energy which is generated at the time of cutting off the current flowing in the electrical load into the energy accumulation means.

9. The control apparatus as in claim 2, wherein the control means includes:

a ramp voltage generator for generating a ramp voltage in response to each starting of driving the electrical load, the ramp voltage varying at a fixed rate irrespective of the voltage of the power supply;

a comparator for comparing the ramp voltage with the detected voltage of the energy accumulation means thereby to control the second energy supplying means.

10. The control apparatus as in claim 2, wherein the control means includes:

a ramp voltage generator for generating a ramp voltage in response to each starting of driving the electrical load, the ramp voltage varying at a rate variable with the voltage of the power supply;

a comparator for comparing the ramp voltage with the detected voltage of the energy accumulation means thereby to control the second energy supplying means.

11. An electrical load control apparatus comprising:

an electrical load;

energy accumulation means connected to the electrical load for accumulating energy to be supplied to the electrical load; and control means for driving the electrical load by using energy accumulated in the energy accumulation means, wherein the control means detects a voltage of the energy accumulation means at the time of starting to drive the electrical load, and controls a current flowing in the electrical load in accordance with the detected voltage; and said control apparatus further comprising:

recovery means for recovering into the energy accumulation means energy of a counter-electromotive force of the electrical load generated when the current flowing in the electromotive load is cut off, wherein the electrical load includes a solenoid which opens and closes a valve body of a fuel injector, and the energy accumulation means is set to retain an offset of at least a predetermined quantity when the energy of the counter-electromotive force is recovered so that a valve closing time may be maintained constant, and wherein the offset is set to correspond to an amount of the energy produced when a voltage of more than 50 volts is applied.

12. An electrical load control apparatus comprising:

an electrical load;

energy accumulation means connected to the electrical load for accumulating energy to be supplied to the electrical load; and control means for driving the electrical load by using energy accumulated in the energy accumulation means, wherein the control means detects a voltage of the energy accumulation means at the time of starting to drive the electrical load, and controls a current flowing in the electrical load in accordance with the detected voltage;

the electrical load includes a plurality of solenoids of injectors for supplying fuel to an engine;

the injectors being grouped into different groups so that the injectors in each group do not operate at the same time;

the energy accumulation means includes a plurality of capacitors which are connected to the groups of the injectors, respectively, each capacitor being sized to have the accumulated energy sufficient to operate each solenoid at least twice; and the control means drives the solenoids by using the accumulated energy of corresponding one of the capacitors.

13. An electrical load control apparatus comprising:

an electrical load;

energy accumulation means connected to the electrical load for accumulating energy to be supplied to the electrical load;

current detection means for detecting a current flowing in the electrical load;

control means for driving the electrical load by using energy accumulated in the energy accumulation means, wherein the control means stops a supply of the accumulated energy to the electrical load in accordance with the detected current.

14. An electrical load control apparatus comprising:

an electrical load;

energy accumulation means connected to the electrical load for accumulating energy to be supplied to the electrical load;

current detection means for detecting a current flowing in the electrical load;

control means for driving the electrical load by using energy accumulated in the energy accumulation means, wherein the control means stops a supply of the accumulated energy to the electrical load in accordance with the detected current; and said control apparatus further comprising:

recovery means for recovering into the energy accumulation means energy of a counter-electromotive force which is generated when the current flowing in the electrical load is cut off.

15. The control apparatus as in claim 14, wherein:

the electrical load includes a solenoid which opens and closes a valve body of a fuel injector; and the energy accumulation means is set to retain an offset of at least a predetermined quantity when the energy of the counter-electromotive force is recovered;

the offset is determined to maintain a valve closing time of the injector at a fixed time irrespective of the accumulated energy of the energy accumulation means.

16. The control apparatus as in claim 13, further comprising:

voltage raising means for raising the voltage of the energy accumulation means to be higher than a fixed voltage of a power supply.

17. An electrical load control apparatus comprising:

an electrical load;

energy accumulation means connected to the electrical load for accumulating energy to be supplied to the electrical load;

current detection means for detecting a current flowing in the electrical load;

control means for driving the electrical load by using energy accumulated in the energy accumulation means, wherein the control means stops a supply of the accumulated energy to the electrical load in accordance with the detected current;

the electrical load includes a plurality of solenoids of injectors for supplying fuel to an engine;

the injectors are grouped into different groups so that the injectors in each group do not operate at the same time;

the energy accumulation means includes a plurality of capacitors which are connected to the groups of the injectors, respectively, each capacitor being sized to have the accumulated energy sufficient to operate each solenoid at least twice; and the control means drives the solenoids by using the accumulated energy of corresponding one of the capacitors.

18. The control apparatus as in claim 13, wherein:

the control means detects a voltage of the energy accumulation means at the time of starting to drive the electrical load, and controls the current flowing in the electrical load in accordance with the detected voltage.

19. An electrical load control apparatus comprising:

an electrical load;

energy accumulation means connected to the electrical load for accumulating energy to be supplied to the electrical load;

current detection means for detecting a current flowing in the electrical load;

control means for driving the electrical load by using energy accumulated in the energy accumulation means, wherein the control means stops a supply of the accumulated energy to the electrical load in accordance with the detected current;

the control means detects a voltage of the energy accumulation means at the time of starting to drive the electrical load, and controls the current flowing in the electrical load in accordance with the detected voltage; and the control means delays more a timing to start supplying the accumulated energy from a timing of starting an operation of the electrical load, as the detected voltage increases.

20. An electrical load control apparatus comprising:

an electrical load;

energy accumulation means connected to the electrical load for accumulating energy to be supplied to the electrical load; and control means for driving the electrical load by using energy accumulated in the energy accumulation means, wherein the control means detects a voltage of the energy accumulation means at the time of starting to drive the electrical load, and controls a current flowing in the electrical load in accordance with the detected voltage;

the energy accumulation means includes a capacitor being sized to have the accumulated energy sufficient to operate the electrical load at least twice; and the control means drives the load by using the accumulated energy of corresponding one of the capacitor.

21. An electrical load control apparatus comprising:

an electrical load;

energy accumulation means connected to the electrical load for accumulating energy to be supplied to the electrical load;

current detection means for detecting a current flowing in the electrical load;

control means for driving the electrical load by using energy accumulated in the energy accumulation means, wherein the control means stops a supply of the accumulated energy to the electrical load in accordance with the detected current;

the energy accumulation means includes a capacitor being sized to have the accumulated energy sufficient to operate the electrical load at least twice; and the control means drives the load by using the accumulated energy of corresponding one of the capacitor.

22. The control apparatus as in claim 13, wherein said energy accumulation means includes a capacitor.

23. The control apparatus as in claim 13, wherein the control means starts to supply energy of a vehicle-mounted power supply and the energy accumulation means to the electrical load at the same time, and maintains a supply of the energy of the vehicle-mounted power supply for an operation period of the electrical load even after the supply of energy from the energy accumulation means is stopped.

24. A electrical load control apparatus comprising:

an electrical load;

an energy accumulator connected to the electrical load for accumulating energy to be supplied to the electrical load; and a controller for driving the electrical load by using energy accumulated in the energy accumulator, wherein the controller detects a voltage of the energy accumulator at the time of starting to drive the electrical load, and controls a current flowing in the electrical load in accordance with the detetced voltage; and the controller delays more a timing to start supplying the accumulated energy from a timing of starting an operation of the electrical load as the detected voltage increases, and supplies the accumulated energy to the electrical load for speeding up an operating response of the electrical load at a timing variable with the detected voltage of the energy accumulator.

25. The control apparatus as in claim 24, wherein:

the controller supplies energy of a vehicle-mounted power supply to the electrical load by using a first energy supply, and supplies the accumulated energy for speeding up the operating response of the electrical load by using a second energy supply.

26. The control apparatus as in claim 24, wherein:

the controller starts supplying the accumulated energy to the electrical load at a start of an operation period of the electrical load and stops supplying the accumulated energy as the detected current flowing through the electrical load reaches a predetermined level; and the predetermined level is set higher as the detected voltage increases.

27. The control apparatus as in claim 26, wherein:

the controller stops supplying the accumulated energy to the electrical load after a fixed period of time has lapsed from the start of supplying the accumulated energy.

28. The control apparatus as in claim 25, wherein:

the controller executes a constant current supply from the power supply to the electrical load after stopping supplying the accumulated energy from the energy accumulator to the electrical load.

29. The control apparatus as in claim 24, wherein:

the controller determines the variable timing in accordance with a voltage of the power supply, and advances a timing of operation of the electrical load as the detected voltage of the power supply increases.

30. The control apparatus as in claim 24, further comprising:

voltage raiser for raising the voltage of the energy accumulator to be higher than the voltage of the power supply.

31. The control apparatus as in claim 24, further comprising: energy recovery circuit for recovering a fly-back energy which is generated at the time of cutting off the current flowing in the electrical load into the energy accumulator.

32. The control apparatus as in claim 24, wherein the controller includes:

a ramp voltage generator for generating a ramp voltage in response to each starting of driving the electrical load, the ramp voltage varying at a fixed rate irrespective of the voltage of the power supply; and a comparator for comparing the ramp voltage with the detached voltage of the energy accumulator thereby to control a second energy supply.

33. The control apparatus as in claim 24, wherein the controller includes:

a ramp voltage generator for generating a ramp voltage in response to each starting of driving the electrical load, the ramp voltage varying at a rate variable with the voltage of the power supply; and a comparator for comparing the ramp voltage with the detected voltage of the energy accumulator thereby to control a second energy supply.

34. The control apparatus as in claim 24, further comprising:

recovery circuit for recovering into the energy accumulator energy of a counter-electromotive force of the electrical load generated when the current flowing in the electromotive load is cut off;

wherein the electrical load includes a solenoid which opens and closes a valve body of a fuel injector, and the energy accumulator is set to retain an offset of at least a predetermined quanity when the energy of the counter-electromotive force is recovered so that a valve closing time may be maintained constant; and wherein the offset is set to correspond to an amount of the energy produced when a voltage of more than 50 volts is applied.

35. The control apparatus as in claim 24, wherein:

the electrical load includes a plurality of solenoids of injectors for supplying fuel to an engine;

the injectors being grouped into different groups so that the injectors in each group do not operate at the same time;

the energy accumulator includes a plurality of capacitors which are connected to the groups of the injectors, respectively, each capacitor being sized to have the accumulated energy sufficient to operate each solenoid at least twice; and the controller drives the solenoids by using the accumulated energy of corresponding one of the capacitors.

36. An electrical load control apparatus comprising:

an electrical load;

an energy accumulator connected to the electrical load for accumulating energy to be supplied to the electrical load; and a controller for driving the electrical load by using energy accumulated in the energy accumulator;

wherein the controller detects a voltage of the energy accumulator at the time of starting to drive the electrical load, and controls a current flowing in the electrical load in accordance with the detected voltage;

the controller delays more a timing to start supplying the accumulated energy from a timing of starting an operation of the electrical load, as the detected voltage increases;

the controller starts supplying the accumulated energy to the electrical load at a start of an operation period of the electrical load and stops supplying the accumulated energy as the detached current flowing through the electrical load reaches a perdetermined level; and the predetermined level is set higher as the detected voltage increases.

37. The control apparatus as in claim 36, wherein:

the controller stops supplying the accumulated energy to the electrical load after a fixed period of time has lapsed from start supplying the accumulated energy.

38. The control apparatus as in claim 36, wherein:

the controller executes a constant current supply from the power supply to the electrical load after stopping supplying the accumulated energy from the energy accumulator to the electrical load.

39. The control apparatus as in claim 36, further comprising:

voltage raiser for raising the voltage of the energy accumulator to be higher than the voltage of the power supply.

40. The control apparatus as in claim 36, further comprising:

energy recovery circuit for recovering a fly-back energy which is generated at the time of cutting off the current flowing in the electrical load into the energy accumulator.

41. The control apparatus as in claim 36, wherein the controller includes:

a ramp voltage generator for generating a ramp voltage in response to each starting of driving the electrical load, the ramp voltage varying at a fixed rate irrespective of the voltage of the power supply; and a comparator for comparing the ramp voltage with the detached voltage of the energy accumulator thereby to control a second energy supply.

42. The control apparatus as in claim 36, wherein the controller includes:

a ramp voltage generator for generating a ramp voltage in response to each starting of driving the electrical load, the ramp voltage varying at a rate variable with the voltage of the power supply; and a comparator for comparing the ramp voltage with the detected voltage of the energy accumulator thereby to control a second energy supply.

43. The control apparatus as in claim 36, further comprising:

recovery circuit for recovering into the energy accumulator energy of a counter-electromotive force of the electrical load generated when the current flowing in the electromotive load is cut off, wherein the electrical load includes a solenoid which opens and closes a valve body of a fuel injector, and the energy accumulator is set to retain an offset of at least a predetermined quantity when the energy of the counter-electromotive force is recovered so that a valve closing time may be maintained constant; and wherein the offset is set to correspond to an amount of the energy produced when a voltage of more than 50 volts is applied.

44. The control apparatus as in claim 36, wherein:

the electrical load includes a plurality of solenoids of injectors for supplying fuel to an engine;

the injectors being grouped into different groups so that the injectors in each group do not operate at the same time;

the energy accumulator includes a plurality of capacitors which are connected to the groups of the injectors, respectively, each capacitor being sized to have the accumulated energy sufficient to operate each solenoid at least twice; and the controller drives the solenoids by using the accumulated energy of corresponding one of the capacitors.

45. An electrical load control apparatus comprising:

an electrical load;

an energy accumulator connected to the electrical load for accumulating energy to be supplied to the electrical load;

a current detector for detecting a current flowing in the electrical load;

a controller for driving the electrical load by using energy accumulated in the energy accumulator;

recovery circuit for recovering into the energy accumulator energy of a counter-electromotive force which is generated when the current flowing in the electrical load is cut off;

wherein the electrical load includes a solenoid which opens and closes a valve body of a fuel injector;

the energy accumulator is set to retain an offset of at least a predetermined quantity when the energy of the counter-electromotive force is recovered; and the offset is determined to maintain a valve closing time of the injector at a fixed time irrespective of the accumulated energy of the energy accumulator.

46. The control apparatus as in claim 45, wherein the controller stops a supply of the accumulated energy to the electrical load in accordance with the detected current.

47. The control apparatus as in claim 45, further comprising:

a voltage raiser for raising the voltage of the energy accumulator to be higher than a fixed voltage of power supply.

48. The control apparatus as in claim 45, wherein:

the electrical load includes a plurality of solenoids of injectors for supplying fuel to an engine;

the injectors are grouped into different groups so that the injectors in each group do not operate at the same time;

the energy accumulator includes a plurality of capacitors which are connected to the groups of the injectors, respectively, each capacitor being sized to have the accumulated energy sufficient to operate each solenoid at least twice; and the controller drives the solenoids by using the accumulated energy of corresponding one of the capacitors.

49. The control apparatus as in claim 45, wherein:

the controller detects a voltage of the energy accumulator at the time of starting to drive the electrical load, and controls the current flowing in the electrical load in accordance with the detached voltage.

50. The control apparatus as in claim 49, wherein:

the controller delays more a timing to start supplying the accumulated energy from a timing of starting operation of the electrical load, as detected voltage increases.

51. The control apparatus as in claim 45, wherein:

the energy accumulator includes a capacitor being sized to have the accumulated energy sufficient to operate the electrical load at least twice; and the controller drives the load by using the accumulated energy of corresponding one of the capacitor.

* * * * *